US006019276A

United States Patent [19]

Auclair

[11] Patent Number: 6,019,276

[45] **Date of Patent: *Feb. 1, 2000**

[54] CARTON

[76] Inventor: Jean-Michel Auclair, Mead Packaging Europe—R&D, B.P. 15 Z.I. La Martinerie, 36130 Deols, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,811

[22] PCT Filed: Jan. 11, 1996

[86] PCT No.: PCT/US96/00324

§ 371 Date: Sep. 11, 1997

§ 102(e) Date: Sep. 11, 1997

[87] PCT Pub. No.: WO96/21603

PCT Pub. Date: Jul. 18, 1996

[30] Foreign Application Priority Data

Jan. 10, 1995 [GB] United Kingdom ..... 9500428

[51] Int. Cl.[7] ..... B65D 5/00; B65D 5/46

[52] U.S. Cl. ..... 229/103.2; 229/110; 229/117.14; 229/117.13; 229/186; 229/182.1; 229/122; 229/160.2

[58] Field of Search ..... 229/103.2, 110, 229/182, 129.1, 182.1, 117.13, 117.14, 186, 122, 160.2; 206/427

[56] References Cited

U.S. PATENT DOCUMENTS

| | | | |
|---|---|---|---|
| 1,623,715 | 4/1927 | Berkowitz . | |
| 1,673,109 | 6/1928 | Fenstermacher | 229/930 X |
| 1,892,715 | 1/1933 | Wellman . | |
| 2,372,312 | 3/1945 | Buttery . | |
| 2,465,661 | 3/1949 | Ringler . | |
| 2,751,075 | 6/1956 | Ameson . | |
| 2,764,335 | 9/1956 | Kleingers, Jr. | 229/186 |
| 2,949,219 | 8/1960 | Frankenstein | 229/186 X |
| 3,102,674 | 9/1963 | Hamilton | 229/120.38 X |
| 3,512,697 | 5/1970 | Robinson . | |
| 4,589,246 | 5/1986 | Wood . | |
| 4,667,872 | 5/1987 | Desmond et al. . | |
| 4,747,485 | 5/1988 | Chaussadas . | |
| 4,793,546 | 12/1988 | Nunn . | |
| 4,817,797 | 4/1989 | Hamelin | 206/427 X |
| 4,869,424 | 9/1989 | Wood . | |
| 4,955,531 | 9/1990 | Graboyes | 229/182.1 |
| 5,000,313 | 3/1991 | Oliff | 206/427 X |
| 5,221,041 | 6/1993 | Stout et al. | 229/117.13 |
| 5,221,042 | 6/1993 | Oliff . | |
| 5,307,932 | 5/1994 | Stout et al. | 229/117.13 X |
| 5,328,030 | 7/1994 | Sutherland . | |
| 5,355,998 | 10/1994 | Bienaime | 206/427 X |
| 5,360,113 | 11/1994 | Harris | 206/427 |

FOREIGN PATENT DOCUMENTS

| | | |
|---|---|---|
| 0 084 977 | 8/1983 | European Pat. Off. . |
| 0 475 147 | 3/1992 | European Pat. Off. . |
| 2 698 074 | 5/1994 | France . |
| 43 36 021 | 4/1995 | Germany . |
| 2 201 396 | 9/1988 | United Kingdom . |

OTHER PUBLICATIONS

Advertisement brochure for the Mead product designated as "Ultra–Tracker tray".

*Primary Examiner*—Stephen P. Garbe
*Assistant Examiner*—Tri M. Mai
*Attorney, Agent, or Firm*—Tsugihiko Suzuki

[57] ABSTRACT

A blank for forming a carton for packaging a plurality of articles comprising a series of hingeably interconnected top, first side, bottom and second side panels (12, 14, 16, 18, 20) for forming an open-ended sleeve capable of receiving said articles, the top and bottom panels (12, 18, 20) being similarly non-rectangularly shaped substantially to correlate with the cross-sectional shape of the array of articles in a plan parallel to said top and bottom panels (12, 18, 20), wherein a gusset (38) comprising two hingeably connected gusset panels (58, 60) connects the first side panel (14) and top or bottom panel (12, 18, 20) which gusset (38) is adapted to facilitate movement of the first side panel (14) to correlate with the associated shape of a stowed array of articles during the formation of the carton (10).

5 Claims, 23 Drawing Sheets

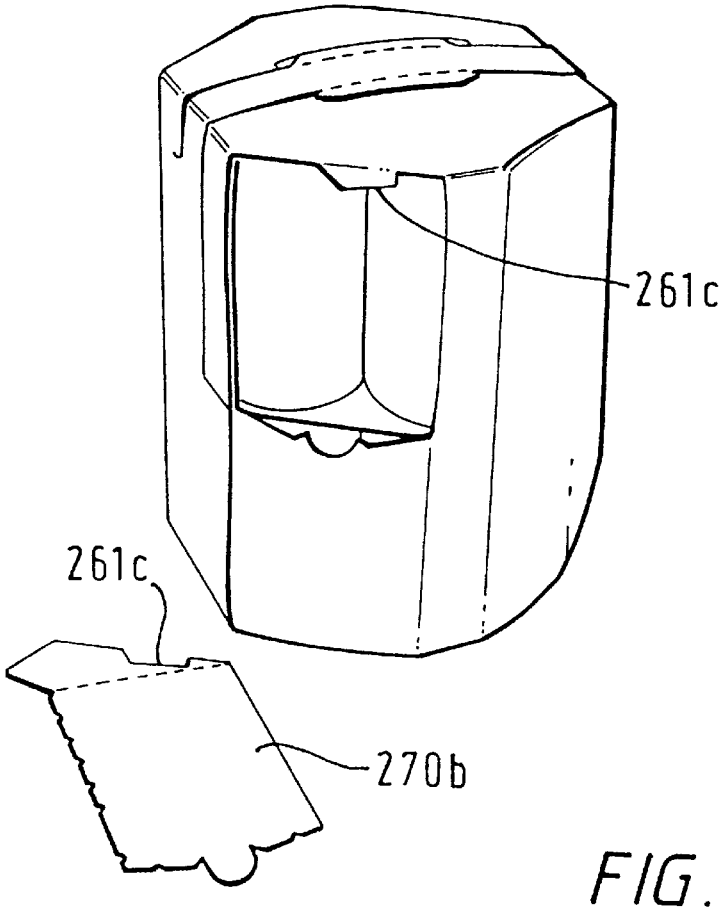
FIG. 18
FIG. 19
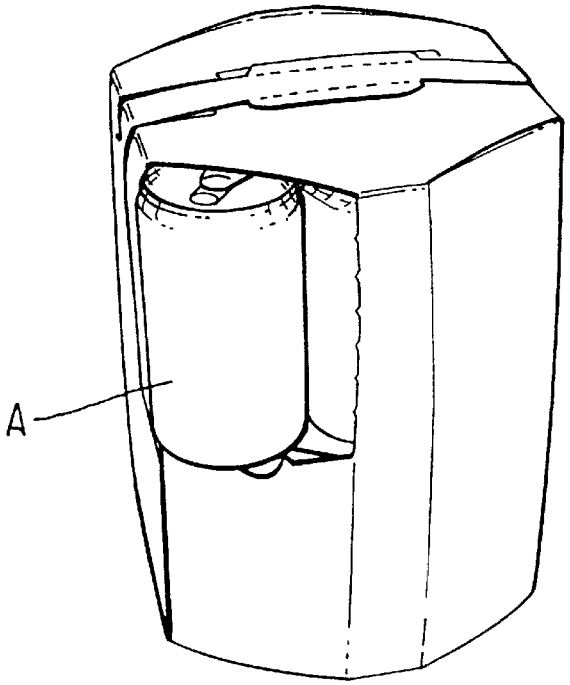

CARTON

The invention relates to cartons for packaging a plurality of articles such as cans or bottles of drink for example, particularly cartons for packaging multiple tier or layers, of articles in a fully enclosed carton for example, and also cartons for packing articles in a non-rectangular array.

A known carton having an octagonally shaped base and top panel is disclosed by Chaussadas in U.S. Pat. No. 4,747,485. The carton comprises a large number of separate panels for closing the sides and ends of the carton. A separate panel is hingably connected to each of the eight edges of the top and base panels. The majority of these panels depend only substantially halfway between the associated top or bottom panel and the opposite bottom or top panel and therefore overlap an associated panel depending from the opposite top or bottom panel. A relatively complex method of folding various panels is therefore required in order to close the carton shown in U.S. Pat. No. 4,747,485.

The invention seeks to avoid or at least mitigate various problems with prior art cartons. According to one aspect of the invention there is provided a blank for forming a carton for packaging a plurality of articles comprising a series of hingably interconnected top, first side, bottom and second side panels for forming an open ended sleeve capable of receiving said articles, the top and bottom panels being similarly non-rectangularly shaped substantially to correlate with the cross-sectional shape of the array of articles in a plane parallel to said top and bottom panels, wherein said side panels comprise a plurality of fold regions adapted to be folded in at least three different planes to conform with the shape of the associated top and/or bottom panel wherein a gusset comprising two hingably connected gusset panels connects the first side panel between adjacent fold regions and top or bottom panel.

The carton blank preferably comprises two gussets between adjacent fold regions of said first side panel and the top or bottom panel which gussets cooperate with associated end portions of the first side panel to cause movement thereof during the formation of the carton. Two gussets can connect both side panels to the top panel and two gussets connect both side panels to the bottom panel.

The fold regions can each comprise a series of hingably connected portions and the hingably connected portions can be separated by curvable portions which provide rounded corners in the completed carton.

One of the gusset panels can comprise a tab which protrudes therefrom to facilitate tucking of the gusset inside the carton during formation thereof. Also, one of the gusset panels can comprise means such as an edge which operably abuts an end of the carton to help retain the associated side panel in its formed position in the carton. Preferably said protruding tab comprises said abutting edge.

Another aspect of the invention provides a blank for forming a carton for packaging a plurality of articles comprising a series of hingably interconnected main panels for forming an open ended sleeve capable of receiving said articles, two opposite main panels being similarly non-rectangularly shaped substantially to correlate with the cross-sectional shape of the array of articles in a plane parallel to said two opposite main panels, wherein two further main panels comprise a plurality of fold regions adapted to be folded in at least three different planes to conform with the shape of the associated opposed main panels wherein a gusset comprising two hingably connected gusset panels connects a first main panel between adjacent fold regions and one of the two opposite main panels.

The gusset can comprise an associated aperture which facilitates folding of the gusset, and the gusset can comprise means which close the aperture when the carton is formed. Other aspects of the invention relate to a carton and of forming a carton.

Embodiments of the invention will now be described, by way of example only, with reference to the accompanying drawings, in which:

FIG. 1 is a plan view of a carton blank for forming a carton according to a first embodiment of the invention;

FIGS. 2 to 6 provide different views of the blank shown in FIG. 1 during the process of forming the carton shown in FIGS. 7 and 8;

FIGS. 16 to 21 are various perspective views of a carton according to a third embodiment of the invention;

Figure 22:
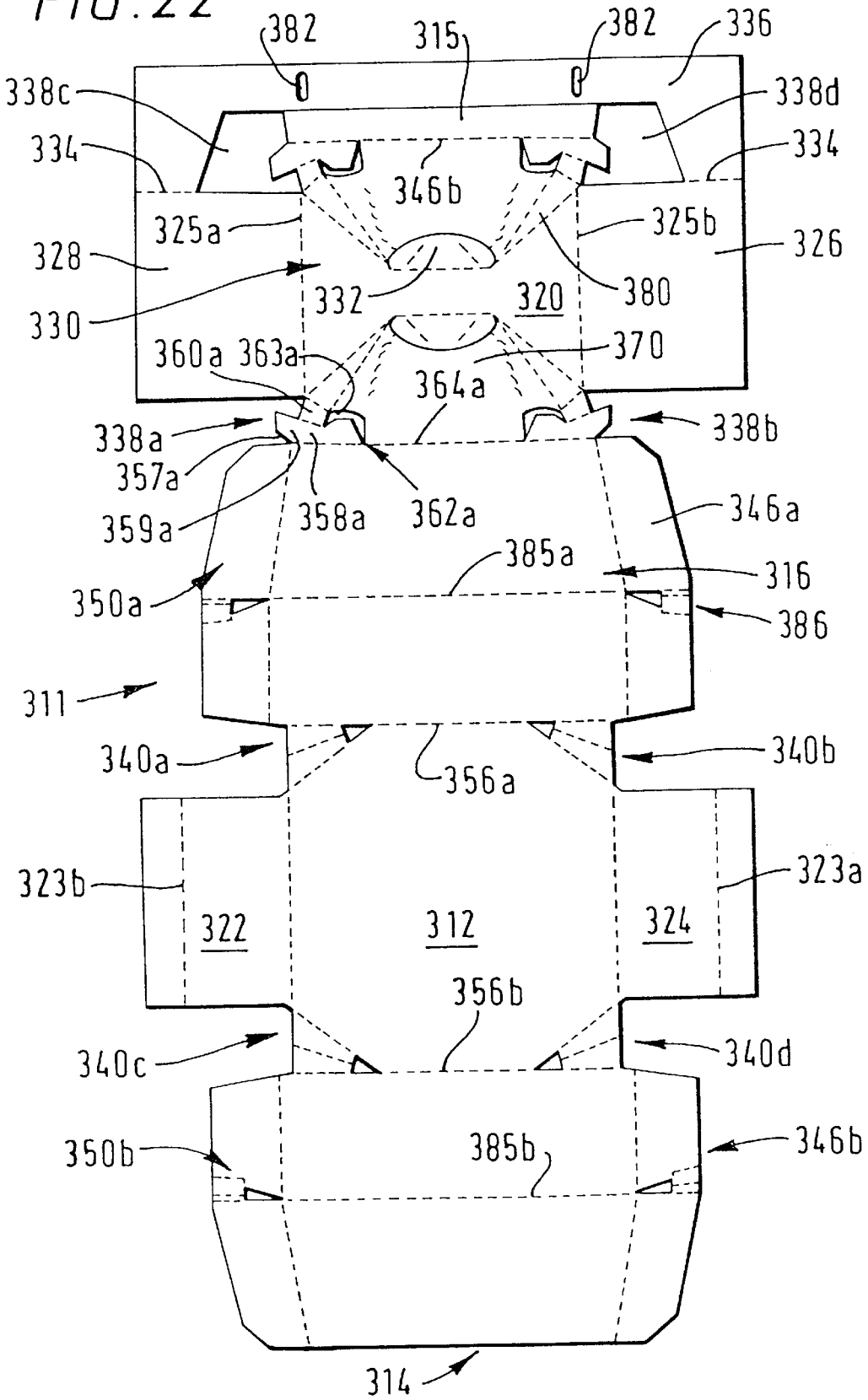
FIG. 22 is a plan view of a blank for forming a fourth embodiment of a carton according to the invention.
Figure 29:
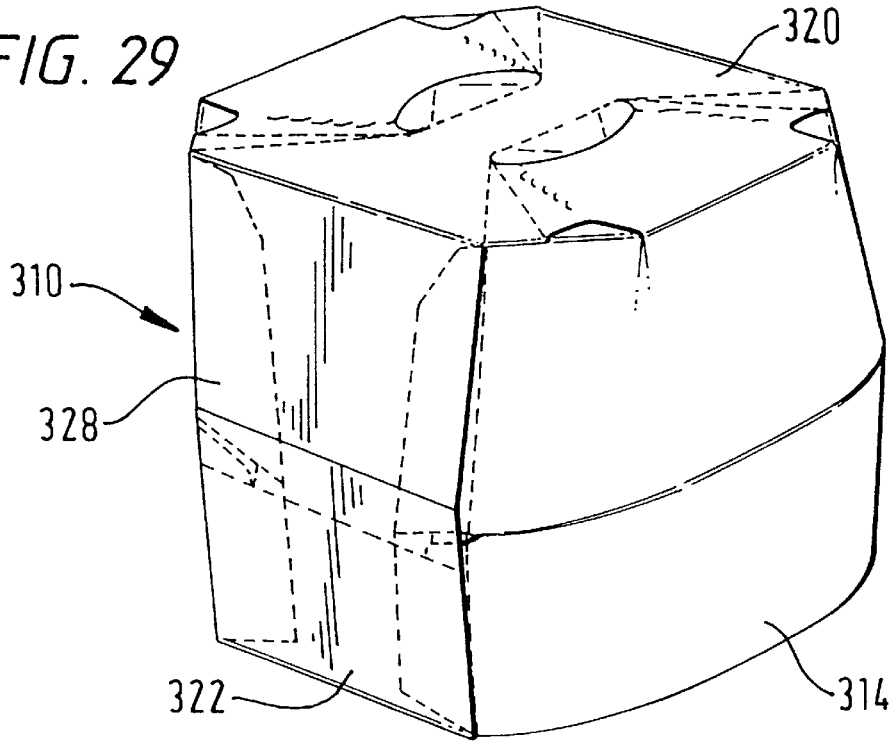
Figure 30:
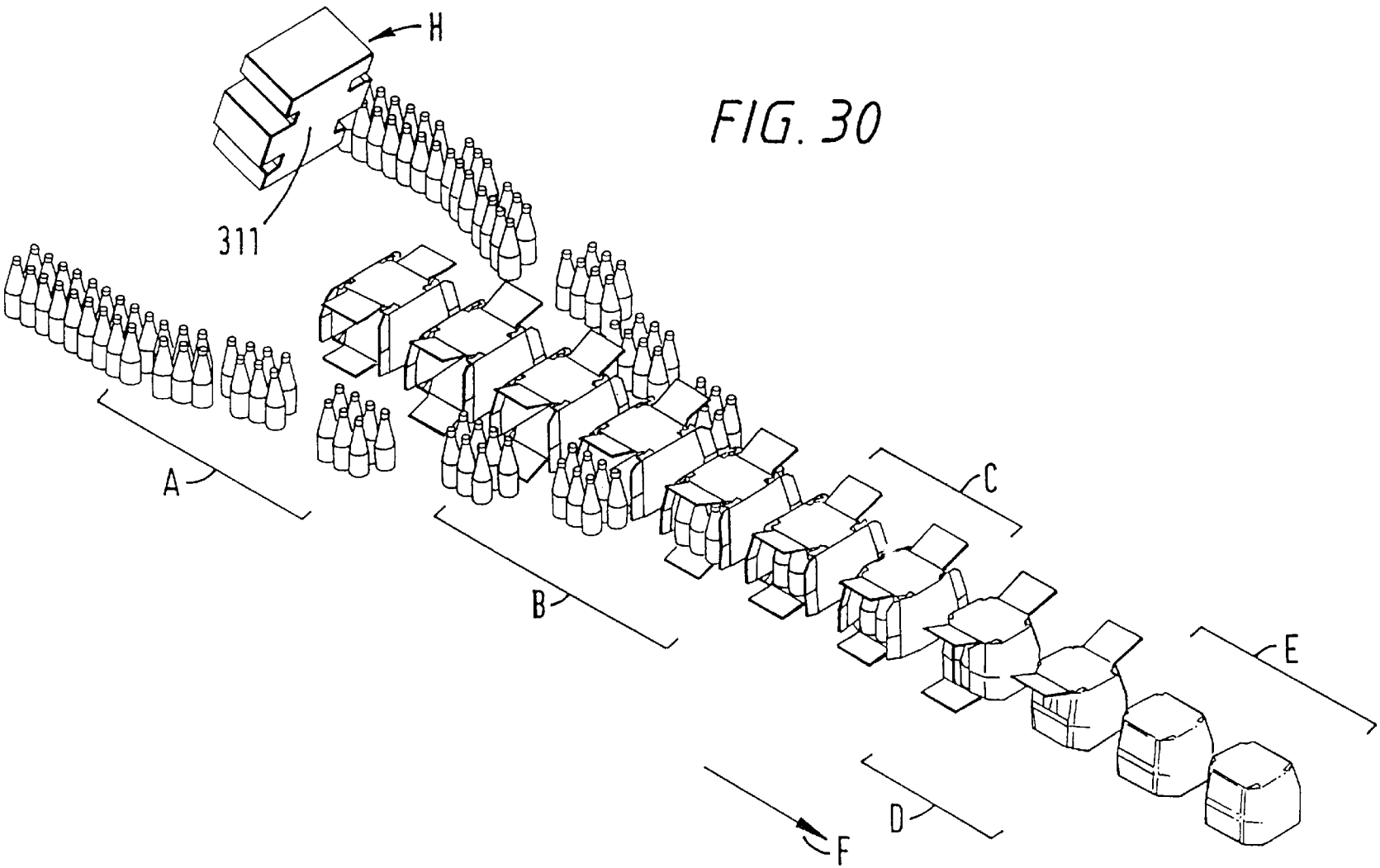

FIGS. 23 to 28 provide views of different stages during the process of forming a carton from the blank shown in FIG. 22;

FIG. 29 is a perspective view of a carton formed from the blank shown in FIG. 22; and FIG. 30 is a schematic representation of the method of loading and closing the carton shown in FIG. 29.

DETAILED DESCRIPTION OF THE PREFERRED EMBODIMENTS

Figure 7:
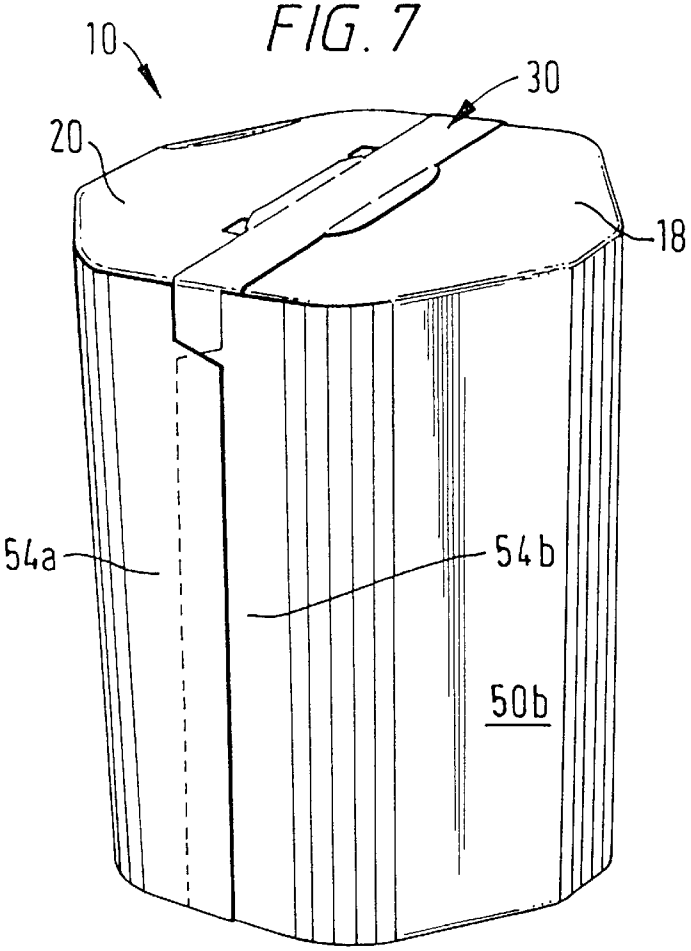
FIGS. 7 and 8 are perspective views of a formed carton according to the first embodiment of the invention.
Figure 6:
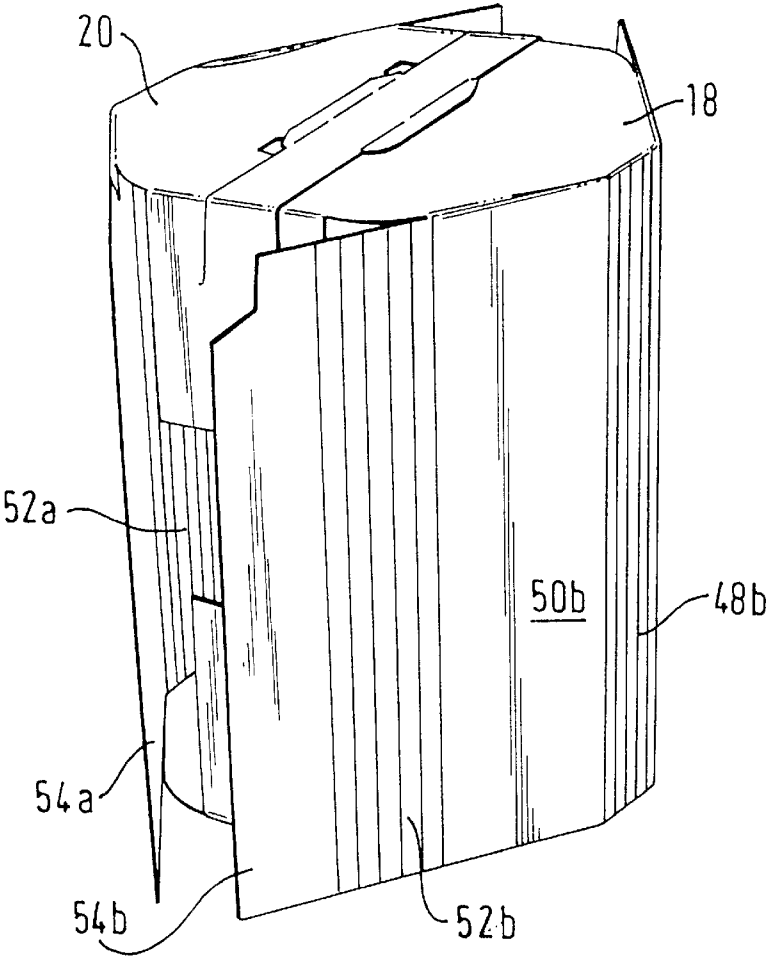
Figure 8:
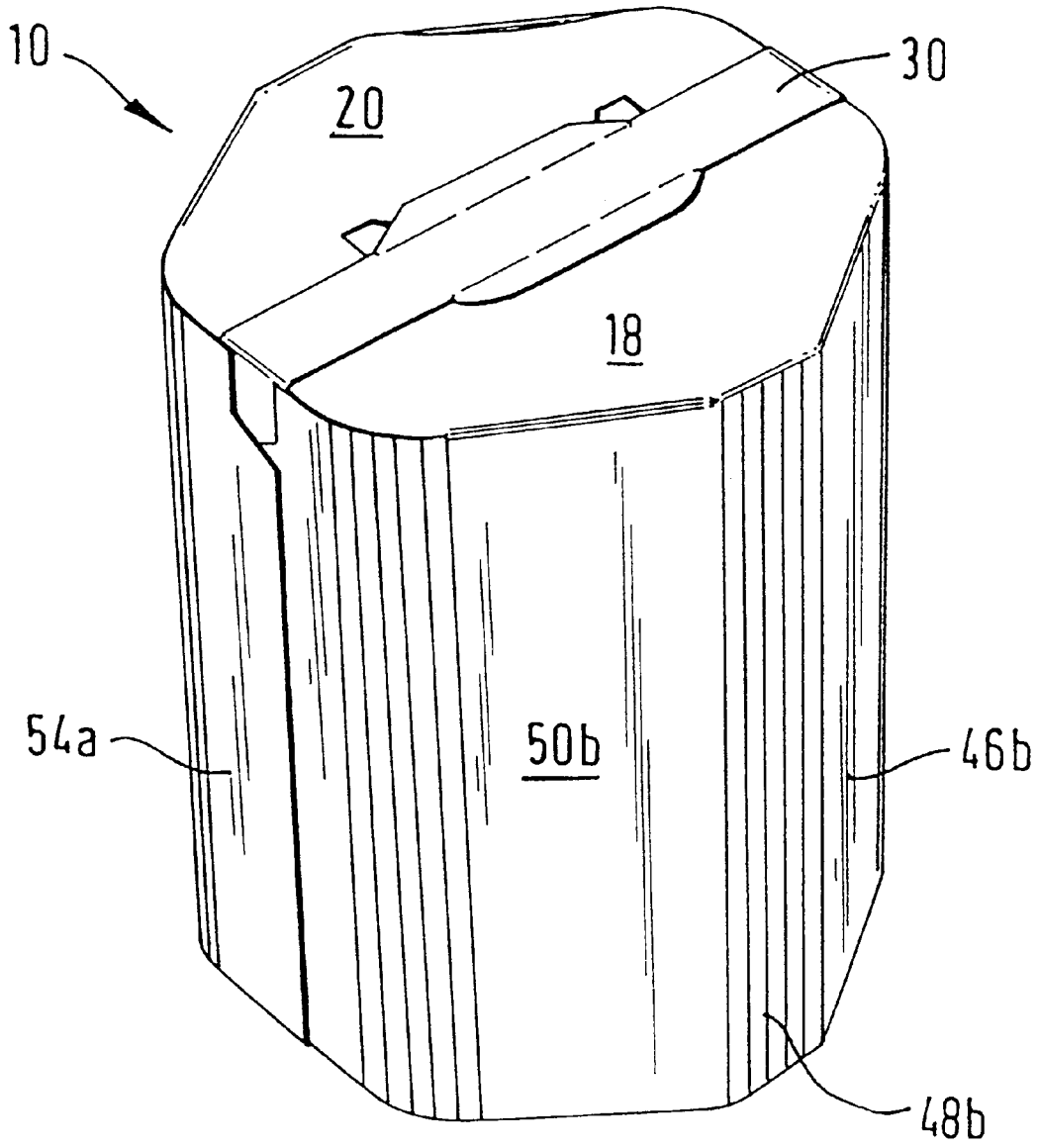

The first embodiment of the invention is shown in FIGS. 1 to 8 wherein a carton blank 11 for forming carton 10 shown in FIGS. 7 and 8. The carton is designed to hold a non-rectangular array of articles such as an array comprising rows of 2, 3 and 2 articles which has a substantially hexagonal cross-section in the horizontal plane. However since articles such as cans and bottles are generally cylindrical or at least have curved sides in the case of bottles, a hexagonal array of such articles has curved corners. In order to tightly pack such an array, carton 10 has curvable side panel portions. Carton 10 can hold a single tier of tall articles or a double tier of articles. Of course multiple tiers can be accommodated simply by adapting the length of its side panels to suit the height of the proposed number of tiers.

Figure 1:
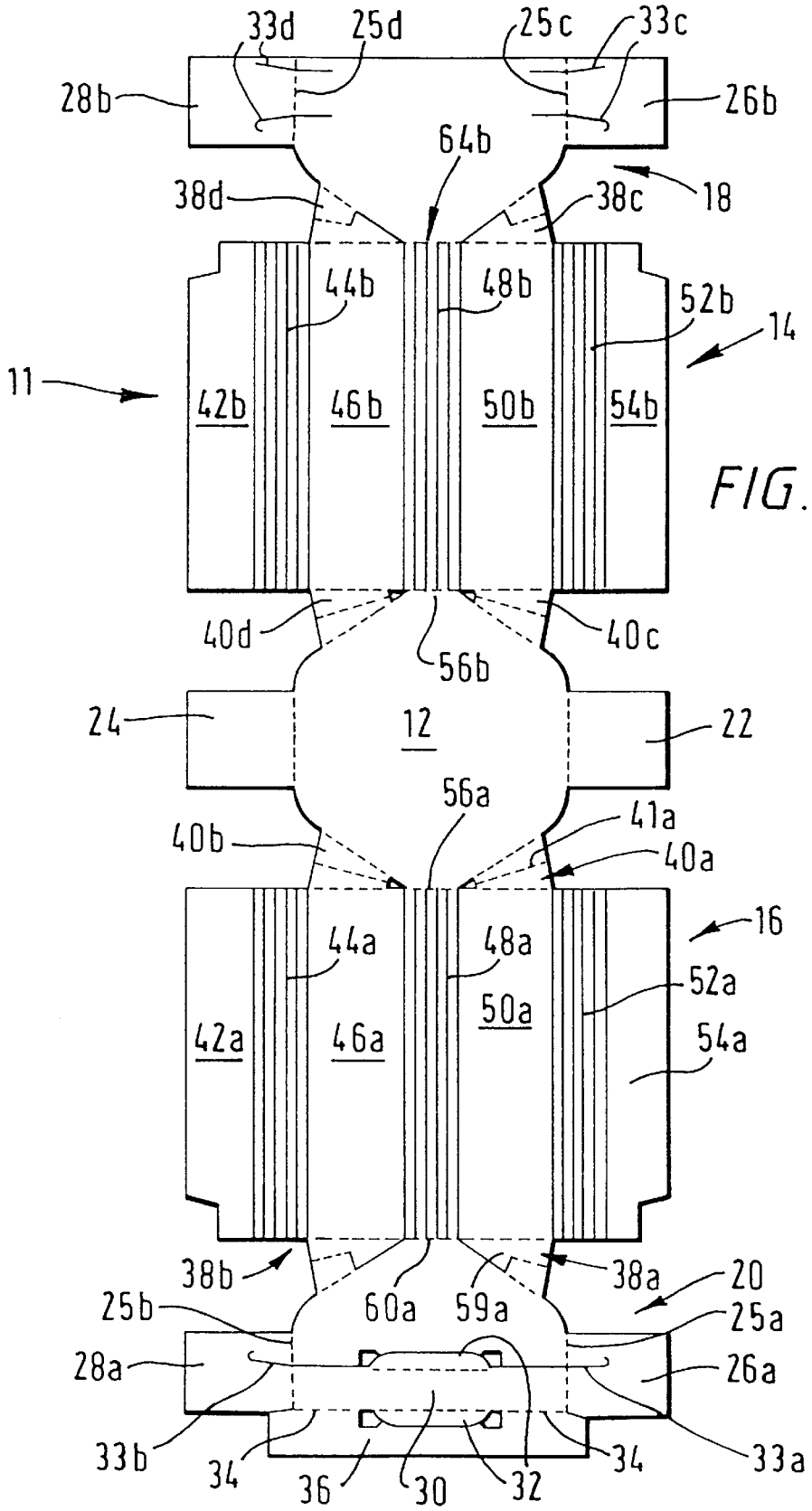

The blank 11 comprises a base panel 12 which is hingably connected to end tabs 22 and 20 and to side panels 14 and 16 via fold lines 56*a* and 56*b*, and gusset panels 40*a*, 40*b*, 40*c* and 40*d* as shown in FIG. 1. Side panels 14 and 16 each comprises a series of side panel portions 42*a* and 42*b*, 46*a* and 46*b*, 50*a* and 50*b*, and 54*a* and 54*b*. The side panel portions are separated from adjacent side panel portion by curvable panel portions 44*a* and 44*b*, 48*a* and 48*b*, and 52*a* and 52*b*. The curvable panel portions comprise a series of crease lines which allow some amount of bending of each of the curvable panel portions in order for the side panels 14 and 16 to be folded around packaged articles in an arcuate manner thereby to fully enclose the sides of the carton. The carton therefore has a cross-section in the horizontal plane which is polygonal, in this case hexagonal, with curved, or rounded, corners.

Side panels 14 and 16 are hingably attached to first and second top panels 18 and 20 respectively. The top panels 18 and 20 are hingably connected to respective side panels 14 and 16 by gussets 38*a,* 38*b,* 38*c* and 38*d* and fold lines 64*a* and 64*b*. The top panels are of the lap type and can be joined together using adhesive or cooperating locking means such as tabs and apertures, for example. Top panel 18 comprises end tabs 26*b* and 28*b* hingably connected thereto along fold lines 25*c* and 25*d* respectively. Slit features 33*c* and 33*d* are positioned at the fold line between the first top panel 18 and each of the end tabs 26*b* and 28*b* but in other embodiments only one or no such features might be provided. These slit features 33*c* and 33*d* enable bending of the fold line between the side tabs and first top panel when handle 30 is used as described later. Handle 30 is provided in second top panel 20 and comprises a strap having finger tabs 32 foldably joined thereto. Second top panel 20 is foldably connected to end tabs 26*a* and 28*a* along fold lines 25*a* and 25*b* respectively and, in this example, the ends of the handle strap extend into end tabs 26*a* and 28*a* along lateral cuts 33*a* and 33*b*. Second top panel 20 also comprises a handle reinforcement panel 36 which, in this example, is hingably connected to the strap of handle 30 along fold lines 34.

Figure 2:
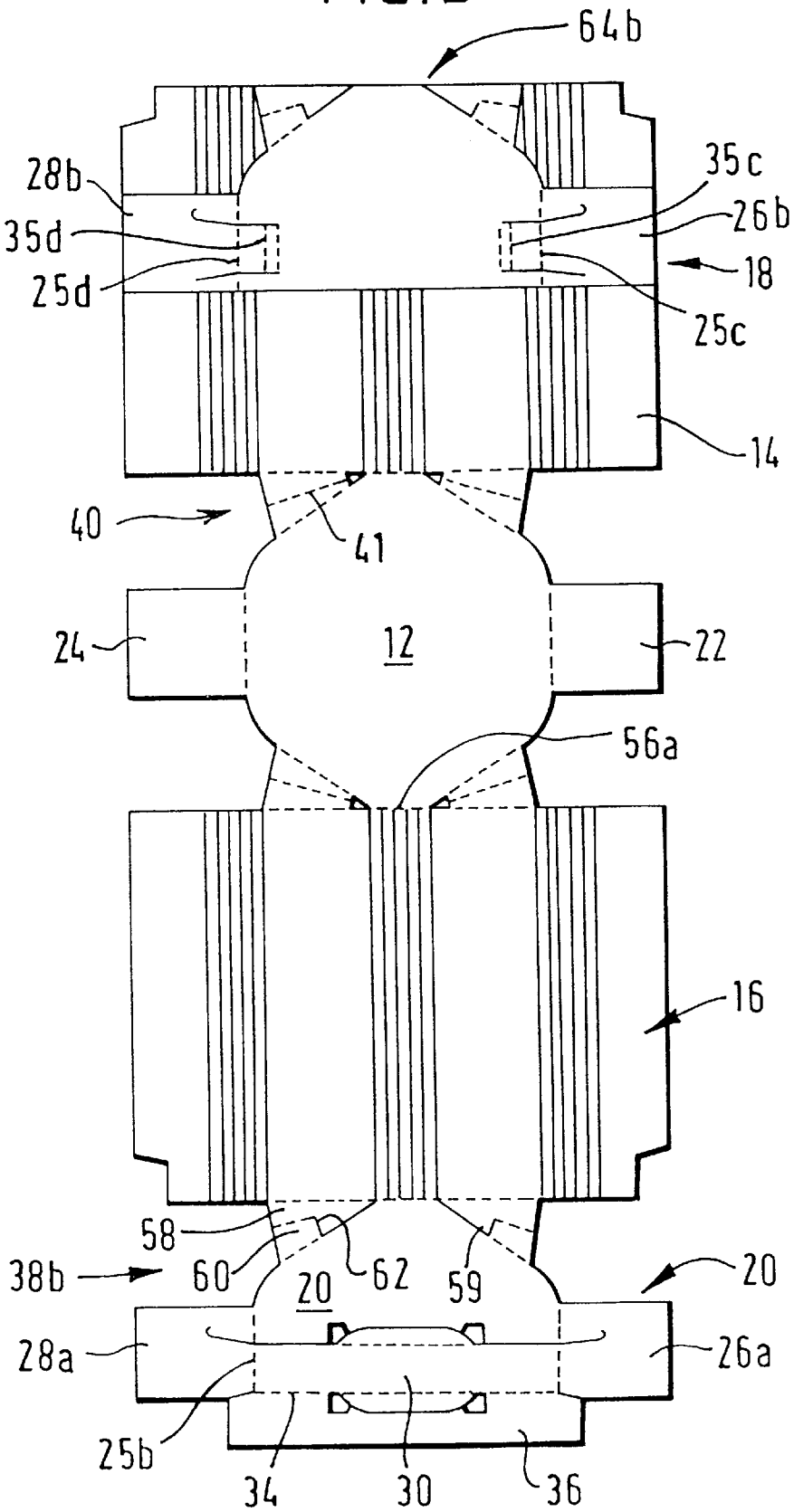
Figure 3:
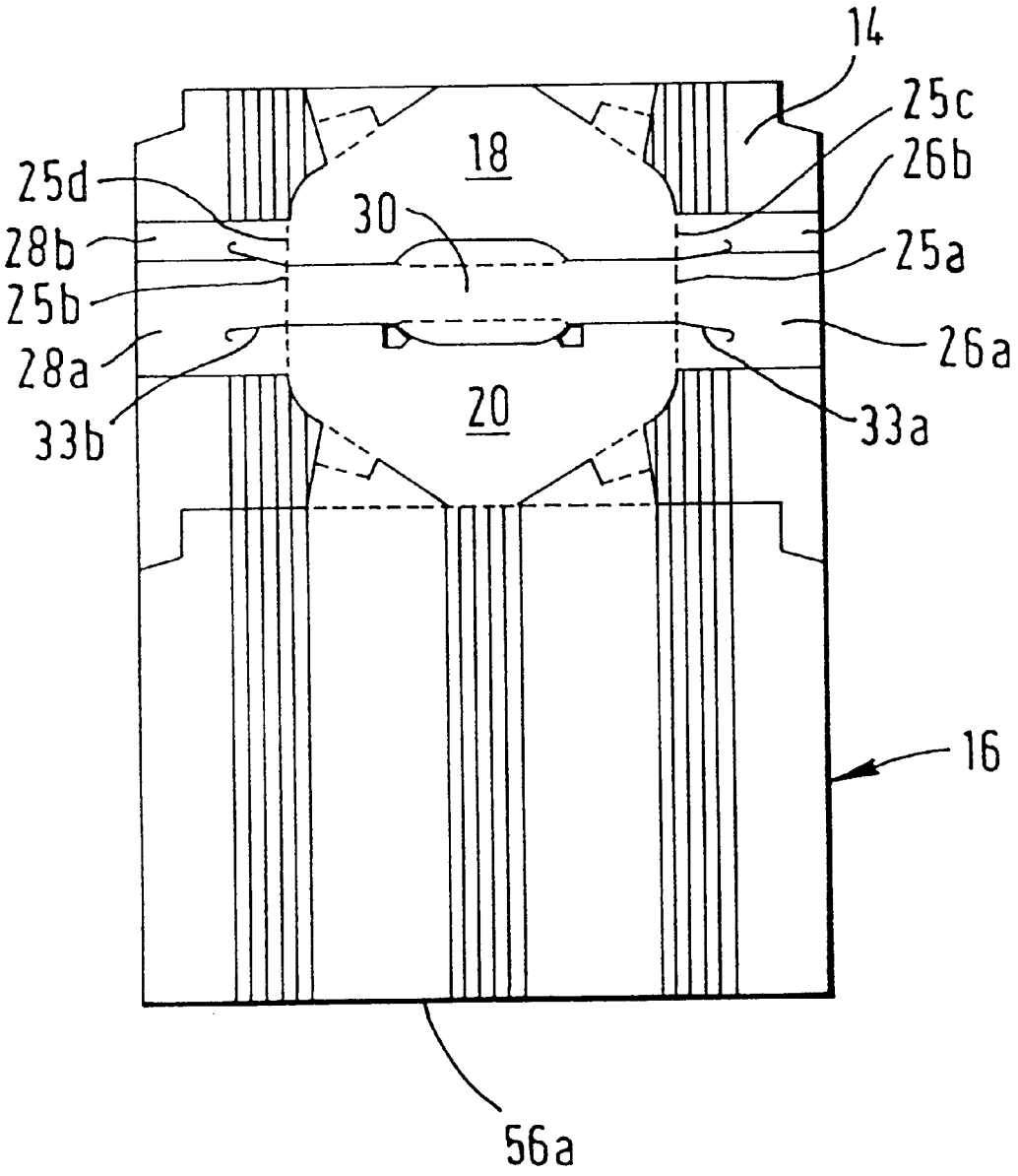

Each of the gussets 38*a,* 38*b,* 38*c* and 38*d* can, as shown in FIG. 2, comprises an outermost panel 58 hingably connected to an innermost panel 60. A cut 62 can be used to separate part of panel 58 from panel 60 and the associated top panel 18 or 20. Thus cut 62 can usefully define a protrusion 59 from outermost gusset panel 58 which protrusion 59, or folding means, can be used to tuck the gusset inside the carton and hence help the folding of the sides of the carton. Lower gussets 40*a,* 40*b,* 40*c* and 40*d* could be formed similar to gussets 38 but here each comprises two symmetrical panels which are hingably connected to one another along a fold line 41.

A method of folding blank 11 to form a completed carton 10 as shown in FIGS. 7 and 8, can be seen in FIGS. 2 to 6. First top panel 18 can be first folded about fold line 64*b* so that it is overlaid on side panel 14. Reinforcement panel 36 can then be folded about fold line 34 beneath handle strap 30 thereby to provide a two-ply handle and thus strengthen the handle. Side panels 16 and second top panel 20 can then be folded about hinge line 56*a* into the configuration shown in FIG. 3. The first and second top panels can then be attached to one another for example by gluing at overlapped portions, or using cooperating locking means (not shown) such as locking tabs and apertures. Of course, other panels could be used as overlap panels to enable a tubular sleeve to be formed.

The handle edges at cuts or slits 33*a* and 33*b* are thus substantially aligned with slit features 33*c* and 33*d* in first top panel 18 in order to allow parts of the hinge or fold lines 25*a,* 25*b,* 25*c* and 25*d* between the top panels and end tabs 26*a* and 28*a,* and 26*b* and 28*b* to move. This enables upward flexing of the handle strap 30 in use by allowing inward movement at the portion of the handle strap adjacent the ends of the carton. To assist in this movement, a pair of lateral creases or fold lines 35*c* and 35*d* can be provided for example in the first top panel 18 as shown in FIG. 2. In this example both the fold lines 35*c* and 35*d,* and associated parts of fold lines 25*c* and 25*d* which extend across the deflectable portion which extends between the end tab and the top panel assist in the inward deflection thereof when handle 30 is used.

Figure 4:
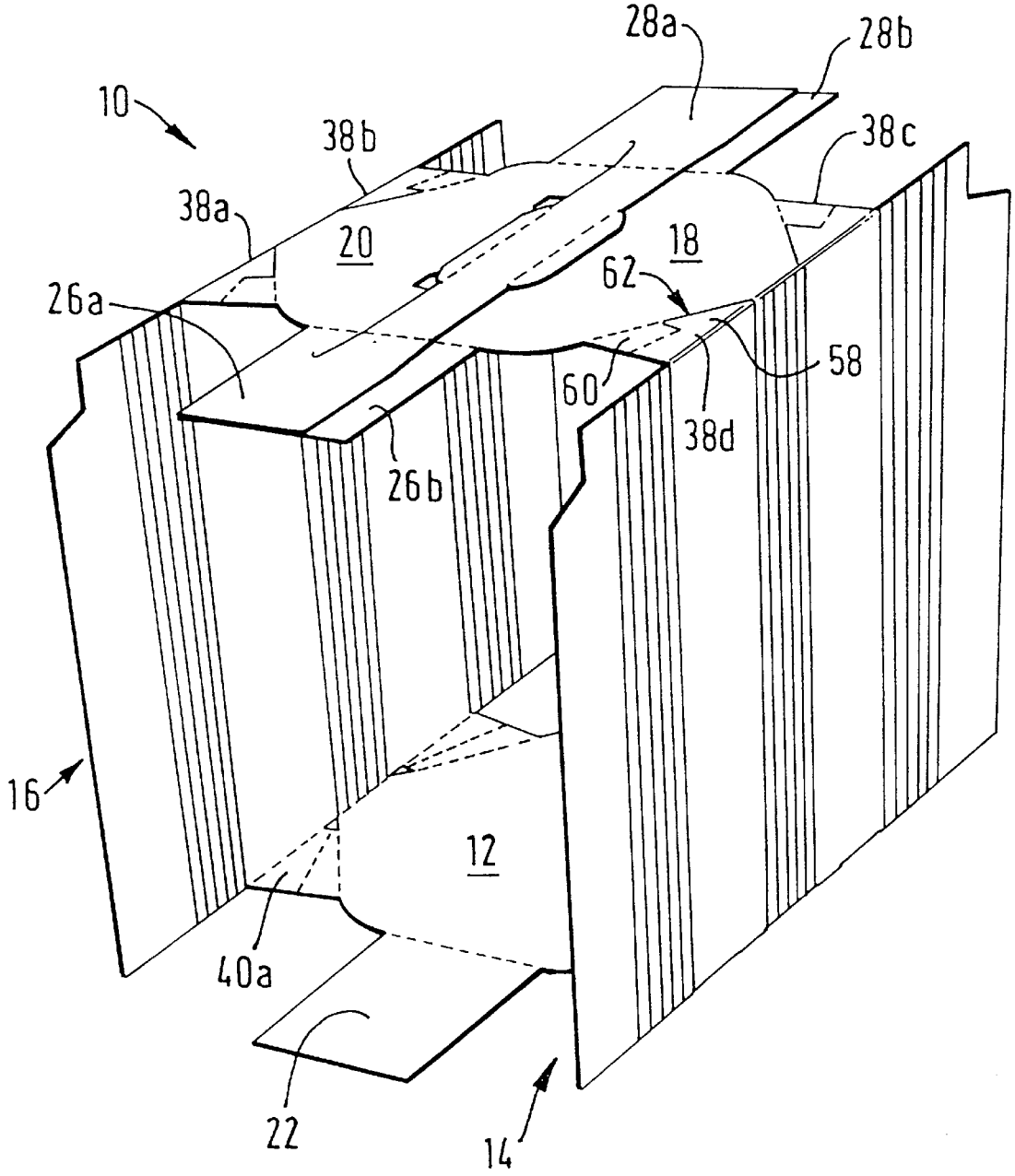
Figure 5:
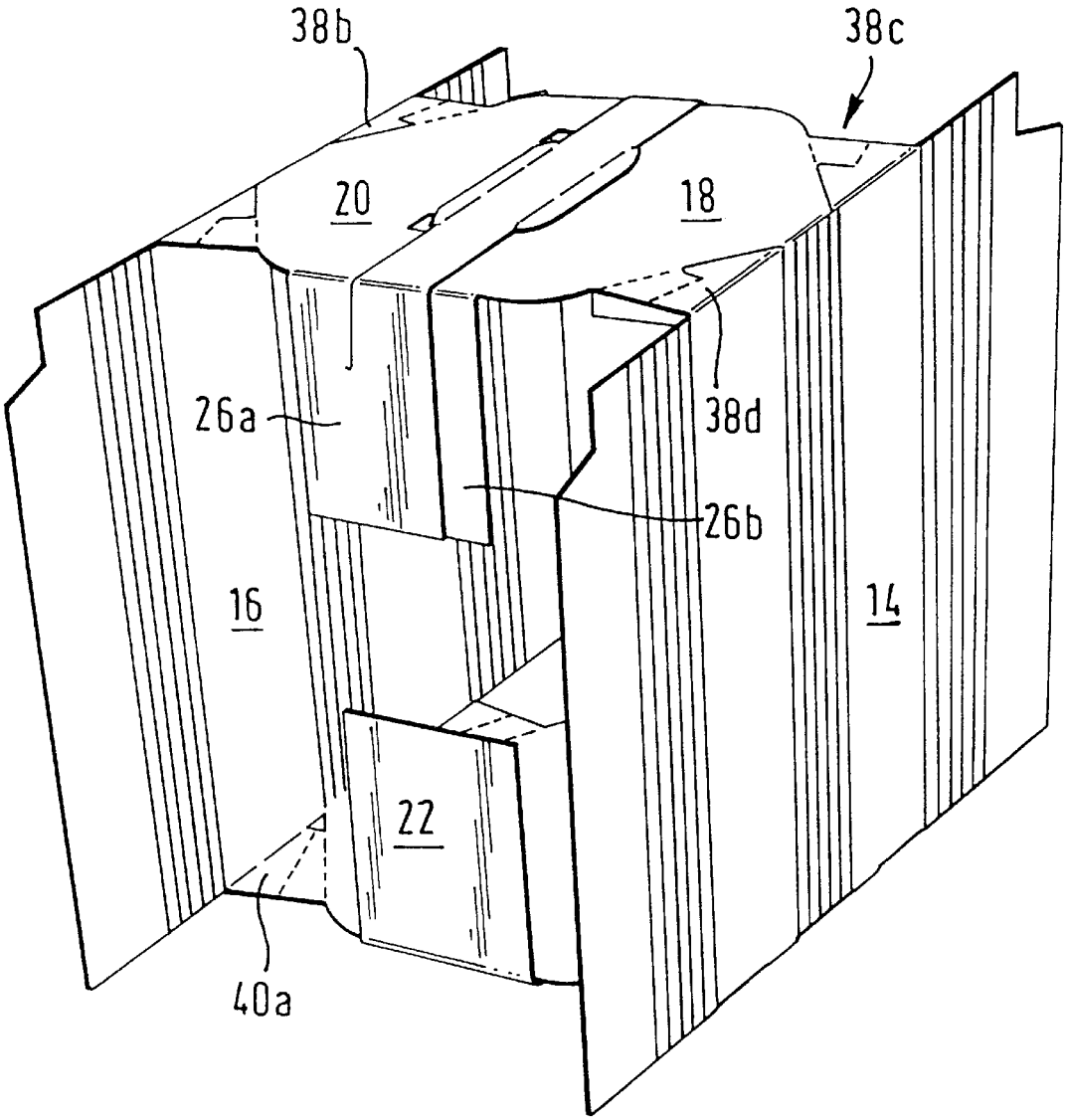

The folded blank can then be opened to form a sleeve like structure as shown in FIG. 4. In this configuration, articles such as cans can be loaded into a partially formed carton 10 through the open ends thereof. After loading the articles, the end tabs 22 and 24 can be folded upwardly whilst end tabs 26*a,* 26*b,* 28*a* and 28*b* can be folded downwardly. The side panel 14 and 16 can then be folded around the articles to close the ends of the carton. For example, gussets 38*a,* 38*b,* 38*c* and 38*d* can be folded into the position under the associated top panel 18 or 20 by pressing inwardly the panel 58 and/or the panel 60 of one or more of the gussets 38. By folding the gussets 38*a* to 38*d* inwardly, the ends of the side panels 14 and 16 are caused to close about the ends of the carton 10. Similarly, by folding gussets 40*a* to 40*d* inwardly of the carton 10, the lower part of side panels 14 and 16 can be caused to rotate to close the ends of the carton.

Associated endmost portions of side panels 14 and 16 are thus brought into an overlapping relationship with each other as shown in FIG. 7. To maintain the carton in its closed configuration, endmost portions 54*a* and 54*b* can be attached to one another, for example by gluing or by cooperating locking means such as locking tabs and apertures. Also, either one or both of the endmost portions 54*a* and 54*b* can be attached to either one or both of end tabs 26*a* and/or 26*b* or end tab 22. Thus, various overlapping portions can be attached together. Similarly the opposite end of the carton can be maintained in a closed position so as to form the fully enclosed carton 10 shown in FIGS. 7 and 8.

It can be seen that carton 10 is designed to fully and tightly enclose an array of articles by having curvable side panels which wrap tightly around the articles. The carton is made aesthetically pleasing by having suitably shaped top and bottom panels which reflect the non-rectangular shape of the stored array of articles. Of course, other non-rectangular arrays such as triangular, rhombic, rhomroidal, and octagonal arrays for example could be used.

A second embodiment of a carton 110 according to the invention is shown in FIGS. 9 to 14. In this embodiment, features substantially similar to those shown in the first embodiment are labelled using the same two digit reference numeral prefixed by the numeral 1. Thus, a first top panel 118 is hingably connected to a side panel 114 which in turn is hingably connected to a base panel 112. The base panel 112 is connected to a second side panel 116 which is hingably connected to a second top panel 120. In this example, handle slots 133 are substantially similar to those in the previous embodiment, however, fold lines 135*c* can be provided to define a displaceable portion 131*c* adjacent the fold lines 125*c* and 125*d* between top panel 118 and end panels 126*b* and 128*b* respectively. Alternatively, those lines labelled 135*c* can be cut lines thereby providing an aperture 131*c* at the fold lines between the first top panel 118 and end panels 126*b* and 128*b*.

In the side panels 114 and 116, the central curvable portions of the first embodiment are replaced by a central panel portion 148*a* and 148*b* and the other side panel portions can be simply hingably connected by a single fold line. In this embodiment, the side panels are also adapted to wrap around the sides of an array of articles to fully enclose the sides thereof. However, the base panel 112 and carton top panel, formed from panels 118 and 120, do not comprise overly rounded corners, but each is an irregular octagon. In this example an array of articles with rows of 1, 2, 2 and 1 articles is intended to be placed in the or each tier. The blank 111 shown is adapted to hold two tiers of such arrays of cans for example.

The side panels are hingably connected to the associated top panel by gussets 138 which can each comprise a main panel 158 for example hingably connected to the associated side panel 114 or 116 and minor panel 160 hingably connected to both the main gusset panel 158 and the associated top panel 118 or 120. An interrupted cut 162 can be used to separate part of panel 158 from panel 160 and the associated top panel 118 or 120. Thus cut 162 can usefully define a protrusion 159 which can be used to tuck the gusset 138 into the position between the associated top panel 118 or 120 and the articles within the carton 110. In other words, the shape of the gusset panels is designed to assist in the folding of the side panels during the closing of the carton after loading. Also, an edge 157, here provided on each of the main gusset panels 158, cooperates in the formed carton with an end panel 126 or 128 to retain the formed shape of the side panels.

Figure 9:
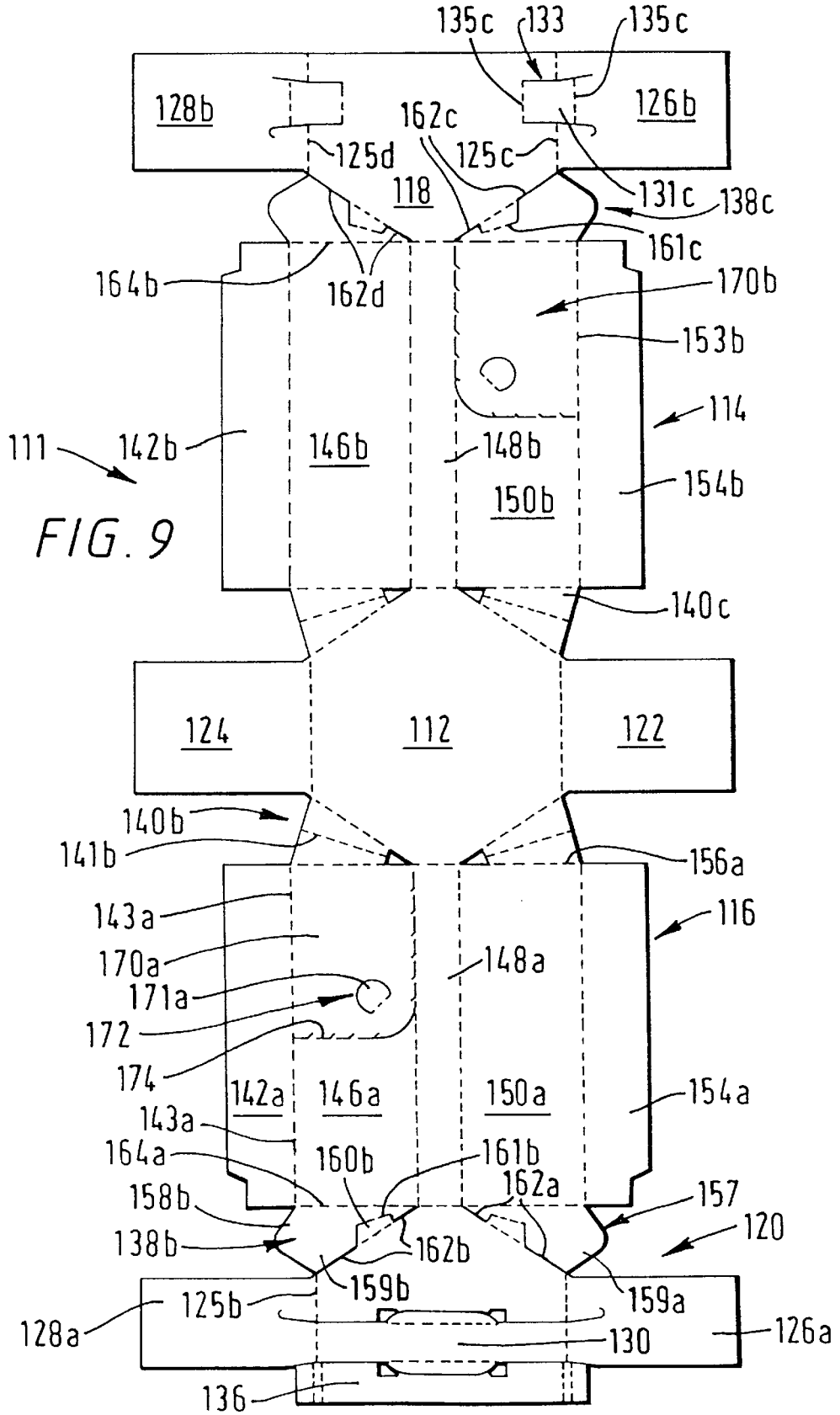
FIG. 9 is a plan view of a blank for forming a carton according to a second embodiment of the invention.

The side panels 114 and 116 here each comprise removable portions 170*a* and 170*b*. These portions can be attached to the carton blank in part at least along a tearable line 174 and by fold lines 153 and 156 or 164 as shown in FIG. 9. The removable portions 170 can comprise means to assist in the removal of the portion from the carton such as a finger aperture 172. The finger aperture can be closed by a hingable tab portion until it is used.

Carton 110 can be formed by folding blank 111 in a manner substantially similar to that described with reference to the first embodiment. Thus top panel 118 can be folded about fold line 164*b*, side panel 116 and top panel 120 can be folded about fold line 156*a* and the top panels attached to one another at overlap portions thereof. A carton sleeve can then be formed and loaded prior folding side panels 114 and 116 round and closing the ends by folding end panels 122, 124, 126*a*, 128*a*, 126*b* and 128*b* about their associated fold lines.

Figure 11:
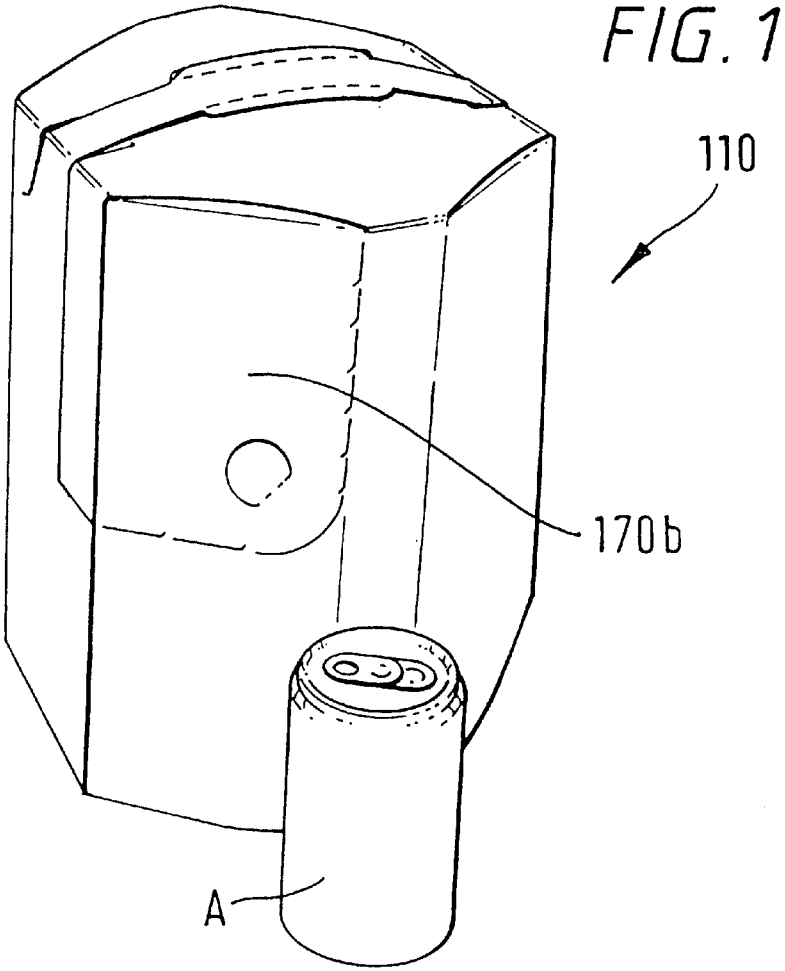
FIGS. 10 to 14 are perspective views of a carton according to the second embodiment of the invention.
Figure 10:
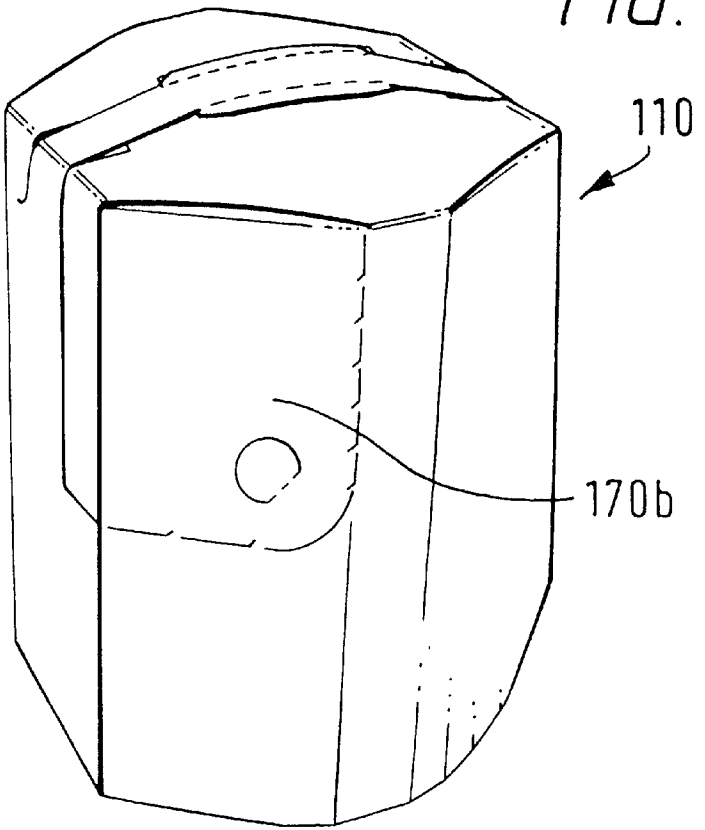
Figure 12:
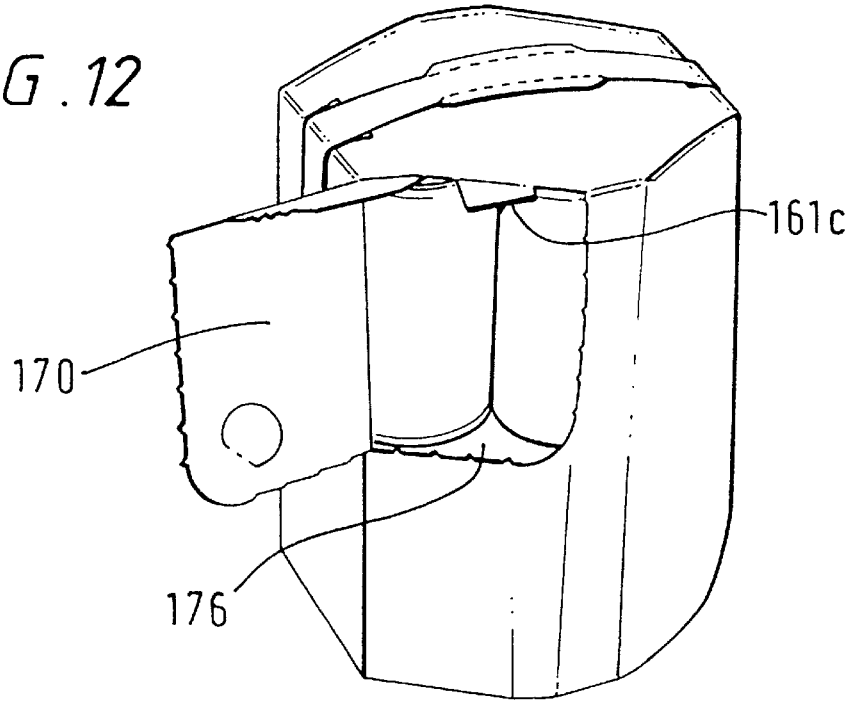
Figure 16:
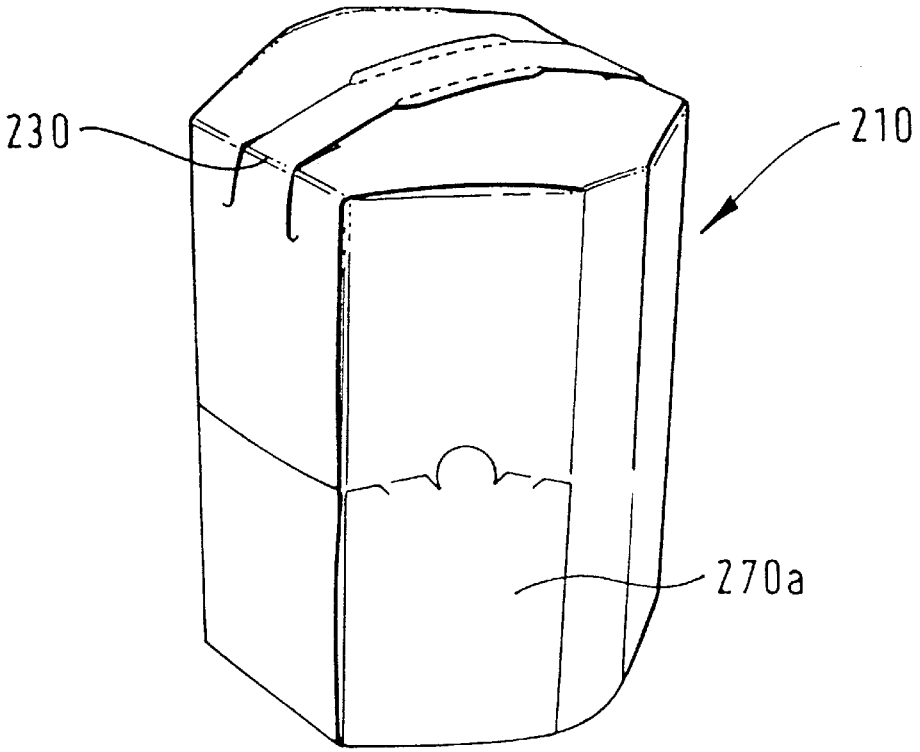
Figure 13:
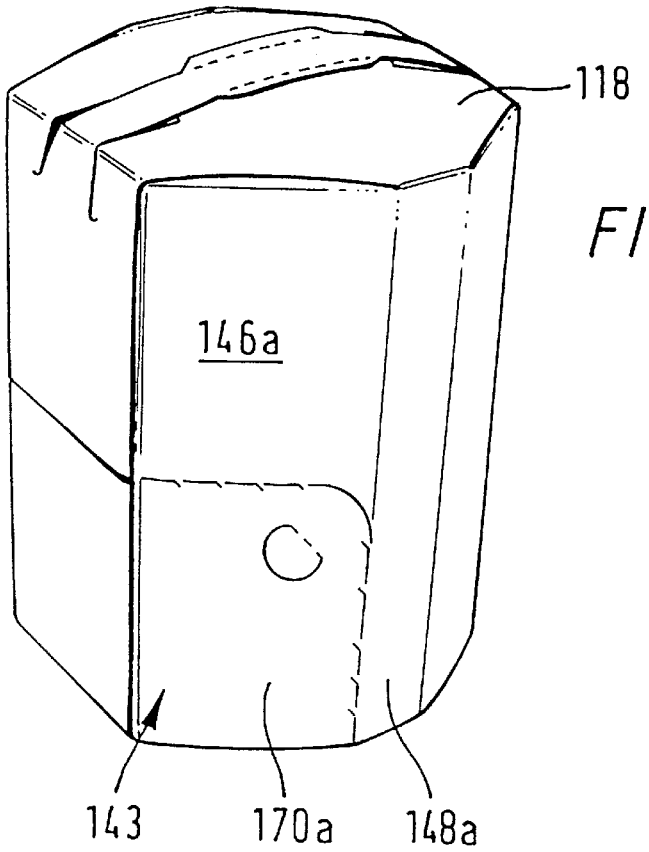
Figure 14:
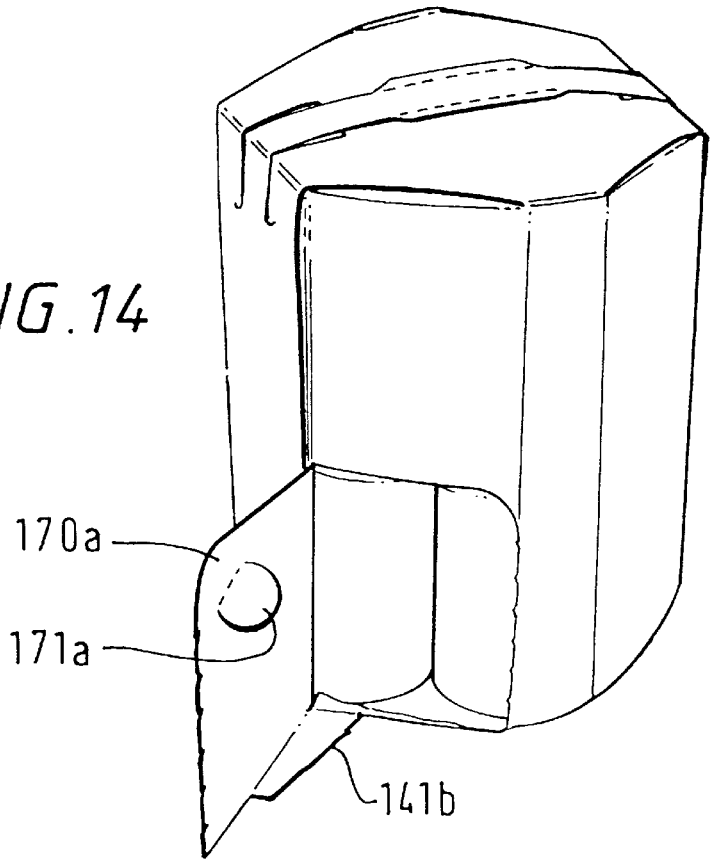
Figure 15:
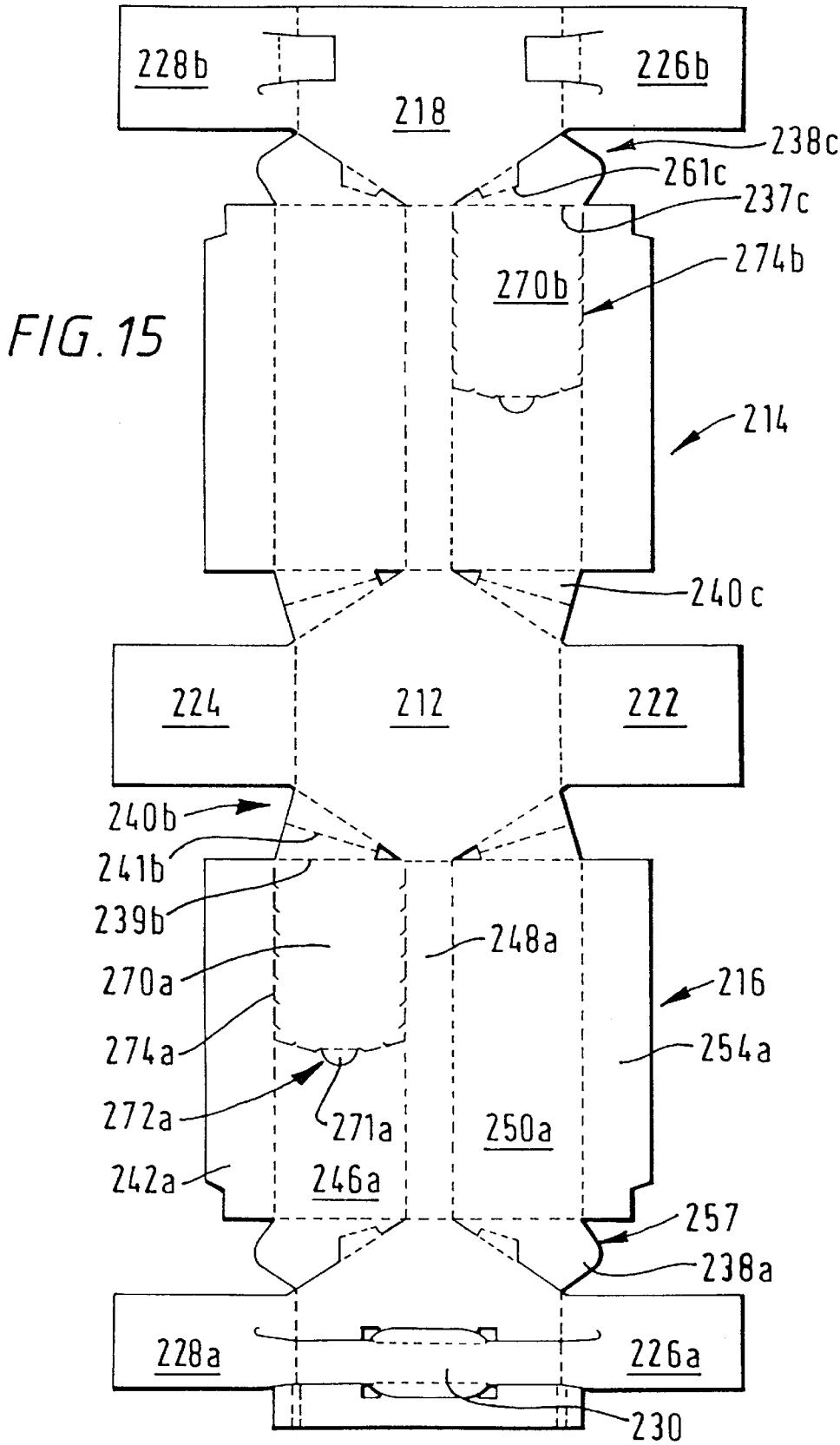
FIG. 15 is a plan view of a blank for forming a carton according to a third embodiment of the invention.

Beneficially, the openable portions 170 enable an article A to be removed from carton 110 without tearing open the entire carton. As shown in FIGS. 11 and 12, openable and closeable portion 170*b* can be opened by breaking the tearable line 174 and opening the panel 170*b* about fold line 153*b*. Additionally, a tear line 161*c* can be provided in gusset 138*c* between gusset panels 158*c* and 160*c* (see FIG. 9) to enable openable panel 170*b* to be fully opened.

As can be seen in FIG. 12, carton 110 can package two tiers of articles which can be separated by a partition panel 176 for example. In order to gain access to the lower tier of articles, a second openable or removable portion 170*a* can be provided. In order to open openable portion 170*a* it is folded about hinge line 143*a* whilst breaking tearable feature 174 and tearable fold line 141*b* between the panels of gusset 140*b* (see FIG. 9). Of course, the gussets could be designed to enable the openable panels to be fully opened without the need of a second tearable feature such as lines 161*c* or 141*b* just described.

Additionally, in this example, the gusset panels 138 are folded beneath the associated upper panel by folding gusset panels 158 and 160 relative to one another about fold line 161 so that both portions are superposed beneath the top panel. The main gusset panel 158 can thus lie adjacent a fold line 125 between end panels 126*a*, 126*b*, 128*a* or 128*b* at edge 157 thereof thereby to provide rigidity at this fold line between the side panels and up to the edge of the handle strap as well as acting to retain the shape of the side panels.

A third embodiment of a carton according to the invention will now be described in relation to the blank and carton shown in FIGS. 15 to 20. In this example of the invention, features similar to those of the first two embodiments are labelled using the same last two digit reference numeral prefixed with the numeral 2. Thus, a first top panel 218 is hingably connected to a side panel 214 which in turn is hingably connected to a base panel 212. A second side panel 216 is hingably connected to both base panel 212 and a second top panel 220. The side panels 214 and 216 are substantially similar to those shown in FIG. 9 as described above, except the openable (and/or removable) portions 270 have a different configuration. In this example, a tearable line 274 extends substantially about three sides of the rectangular panel forming removable portion 270. The openable portion 270*a* and 270*b* are hingably connected on a fourth side along fold lines 239*b* and 237*c* respectively. Each of these fold lines connects the openable portions 270*a* and 270*b* to an associated gusset panel namely 240*b* and 238*c* respectively in this example. A finger aperture 272 can be provided and this can be covered by a foldable tab 271.

Figure 17:
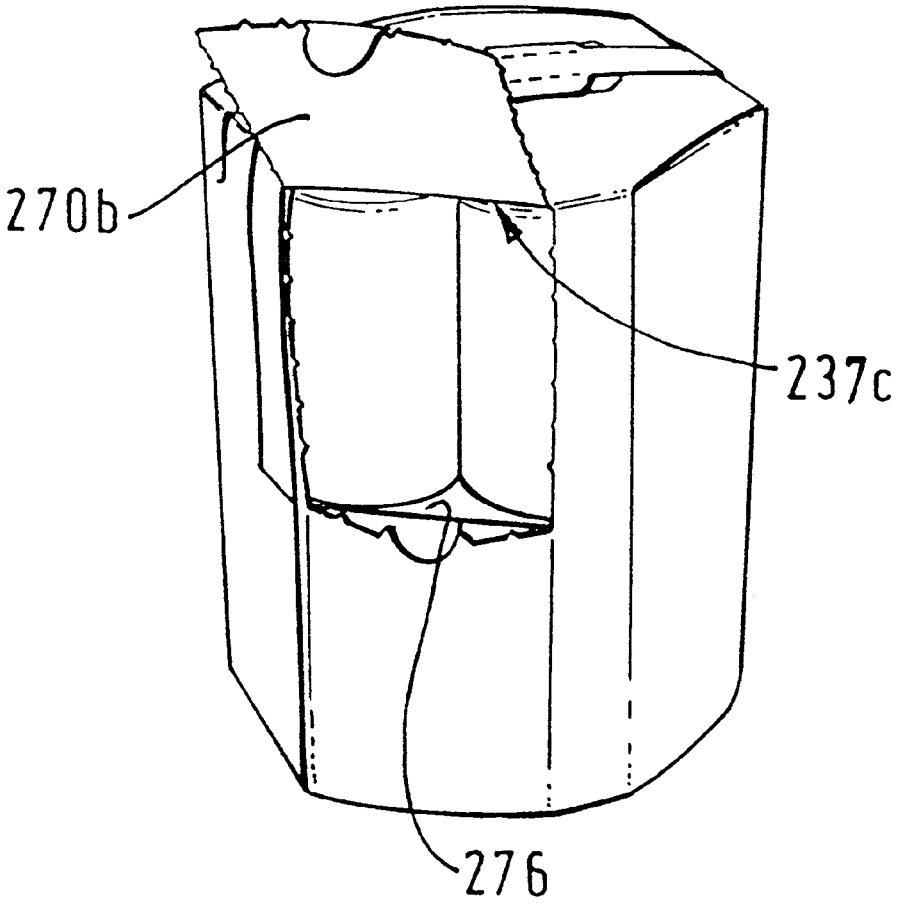
Figure 20:
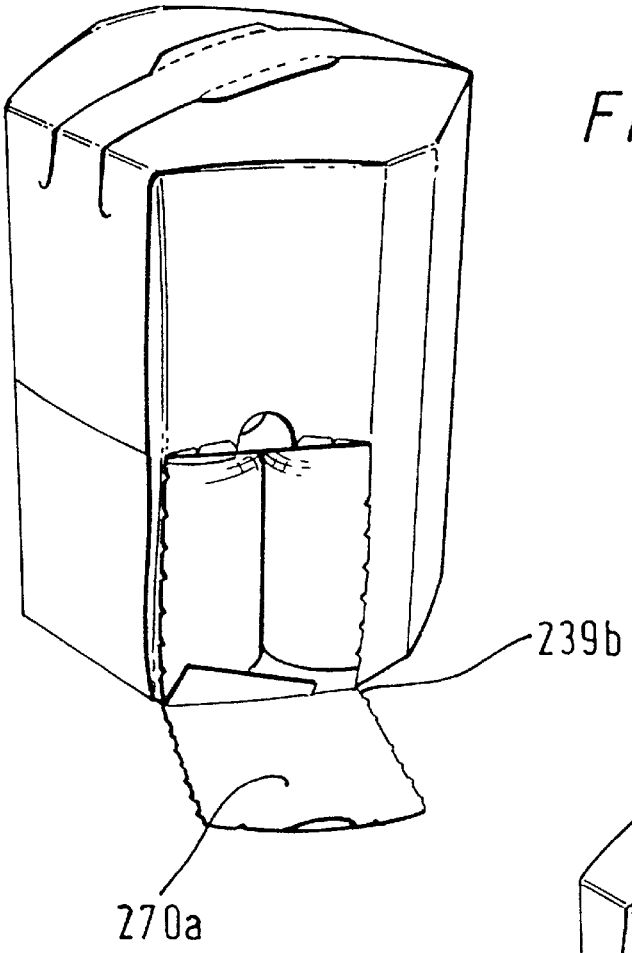
Figure 21:
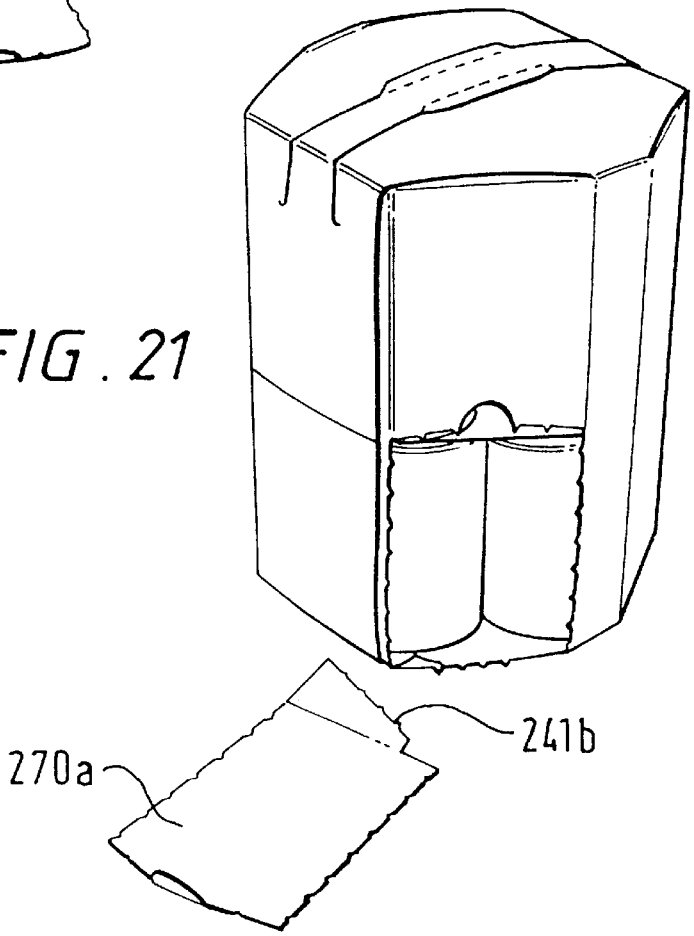

Openable portion 270*b* is foldable about fold line 237*c* in the completed carton as shown in FIG. 17. The portion 270*b* can be removed by tearing along fold line 261*c* as shown in FIG. 18 thereby to leave a carton wherein the articles A in an upper tier are removable as shown in FIG. 19. Similarly, lower openable portion 270*a* is openable by folding about fold line 239*b*. Also, the portion 270*a* can be removed entirely by tearing along fold line 241*b* for example.

In this example the carton 210 is adapted to hold two tiers of articles, wherein each tier comprises an array of 1, 2, 2 and 1 rows of articles. Of course, different numbers of rows of different numbers of articles could be packaged and indeed different numbers of tiers can be housed by suitably adapting the blank described here.

A fourth embodiment of a blank 311 and of a carton 310 formed therefrom as shown in FIGS. 22 to 30. The formed carton 31 shown in FIG. 29 has a generally octagonal cross-section in the horizontal plane and is designed to accommodate a single tier of articles such as bottles in an array of 3, 4, 4, and 3 articles per row.

Blank 311 comprises a top panel 320 which is hingably connected to side panel 316 along fold line 364*a*. In turn, the side panel 316 is hingably connected to base panel 312 having an octagonal shape. The base panel 312 is connected to a second side panel 314 along a fold line 356*b*. In this embodiment, instead of providing overlapping top panels to form the blank into a tubular, sleeve like structure, a tab 315 is provided. In this embodiment tab 315 which is hingably connected to the top panel 320 along a fold line 364*b* can be attached to an upper portion of side panel 314 for example by gluing or by using cooperating locking means such as locking tabs and apertures.

Blank 311 comprises a handle 330 having finger tabs 332 in the top panel 320 and a handle reinforcing strap 336, which here is hingably connected to the end panels 326 and 328 which are hingably connected to the top panel 320. Additionally, diverging crease lines can be formed in the top panel 320 to provide a stress relieving feature 380 for when the handle is used. In this embodiment, openable features 370 are provided in the top panel 320.

The openable features 370 abut the aperture defined by the finger tabs 332 which form part of the handle 330 and have lateral tearable lines similar to lines 274 and 174 shown in the second and third embodiments described herein. Four gussets 338 are provided between the top panel 320 and effectively the side panels of the carton when tab 315 and side panel 314 are attached. The gussets 338 are equivalent in this example and with reference to gusset 338*a* it can be seen that they comprise a main panel 358*a* which is hingably connected to side panel 316. The main panel 358*a* is hingably connected to a minor panel 360*a* which in turn is hingably connected to top panel 320. The main gusset panel 358*a* comprises a protruding tab 359*a* which can be used to close the carton and to retain the associated side wall in a curved formation due to cooperation between the edge 357*a* of tab 359*a* and end panel 328 for example. This cooperation is more apparent with reference to the later drawings. Also, the gusset panel 358 can be positioned between an associated, e.g. cornermost, article top such as a bottle cap and the top panel 320. This can help prevent any aperture opening in the top of the carton when formed in spite of the aperture 363 formed adjacent the gusset.

The side walls 316 and 314 are symmetrical and comprise a main central panel having a medial fold line 385*a* and 385*b* respectively which enable both side panels to be folded substantially in half. This is beneficial in enabling the partially formed carton shown in FIG. 25 to be flat packed ready for erection into the sleeve like structure shown in FIG. 26 which is ready for loading. The medial fold lines 385*a* and 385*b* extend into side panel portions 346*a,* 350*a,* 346*b* and 350*b*. Additionally, a gusset 386 is provided adjacent each fold line 385 in the lateral portions of the side panels. These gussets 386 facilitate better wrapping of the sides and ends of loaded articles and the formation of a sloping upper portion of the side panels which can be seen with reference to FIGS. 27 to 29. To this end fold lines 323*a* and 323*b* are also provided in lower end panel 324 and 322 respectively. In order to form the sloping upper portion it is apparent that top panel 320 should be a smaller octagon than base panel 312. Additionally, in common with the other embodiments, gussets 340 can be provided between base panels 312 and the side panel.

Figure 23:
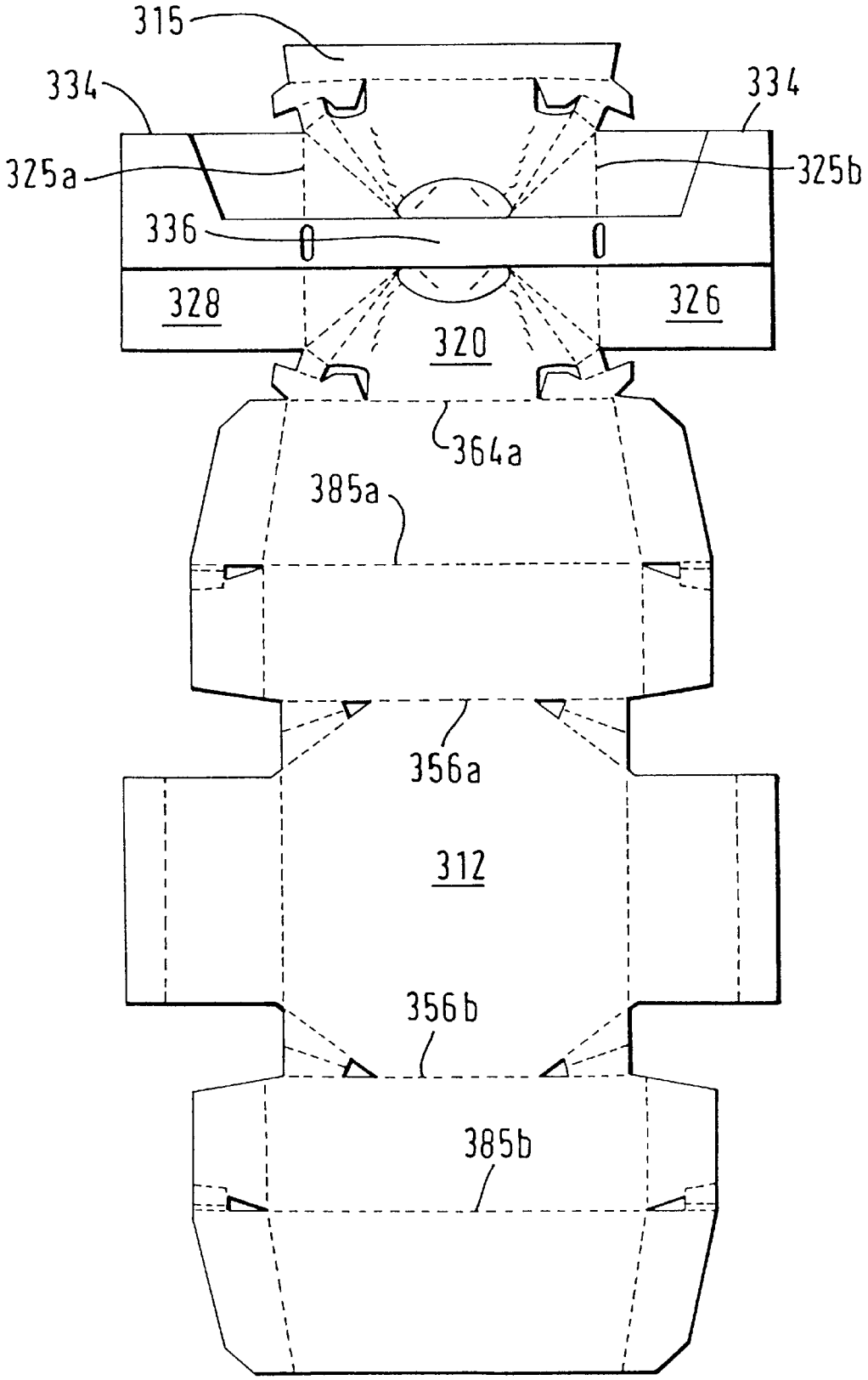
Figure 24:
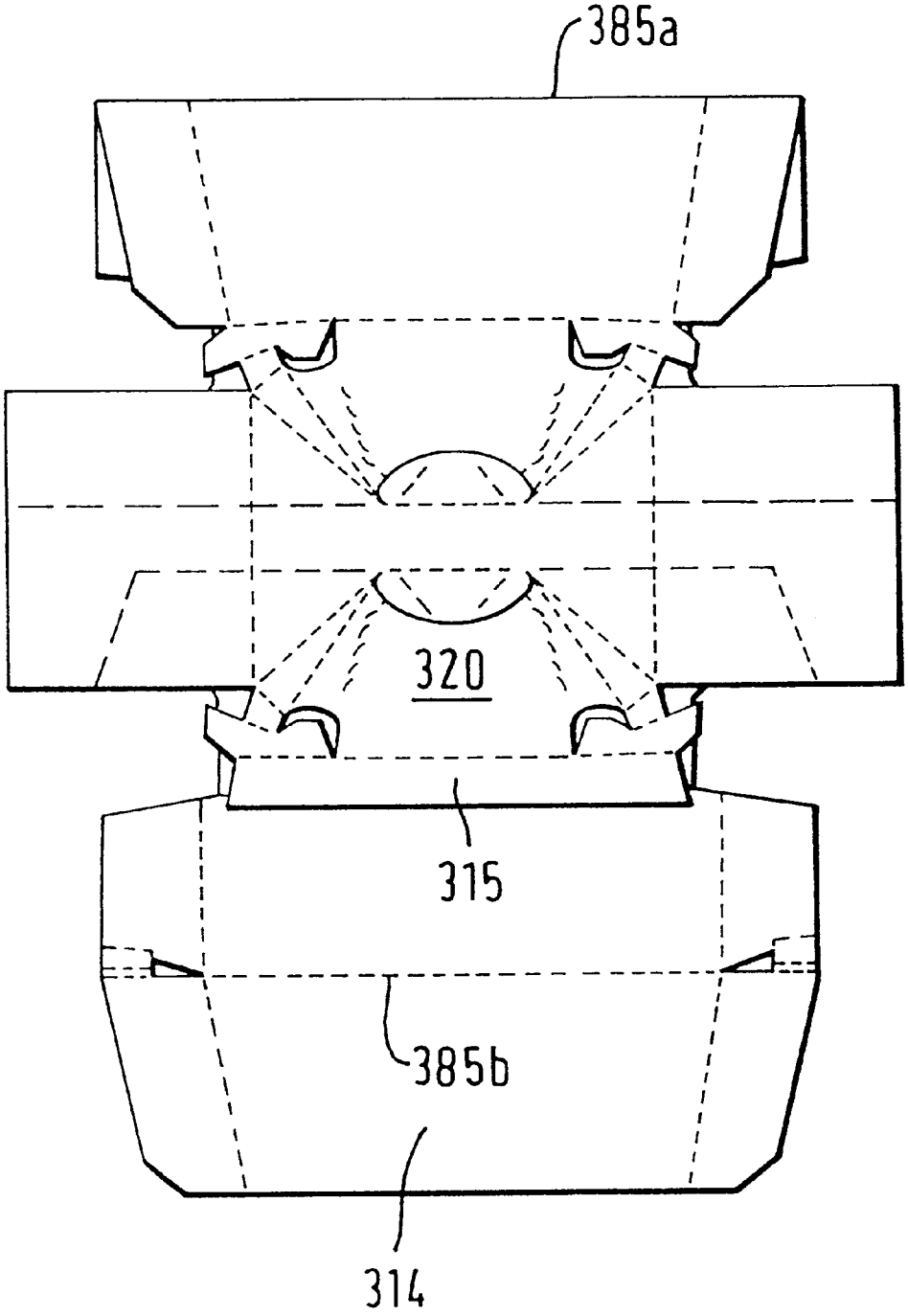

In order to form carton 310 the reinforcing strip 336 is folded about fold line 334 into position shown in FIG. 23. Thus, apertures 382 in strip 336 are aligned with fold lines 325*a* and 325*b* thereby minimising any restriction in the folding of the upper end panels 328 and 326 about fold line 325*a* and 325*b* when closing the ends of a loaded carton. Next, the top panel 320 and upper portion of side panel 316 are folded about fold line 385*a* into the position shown in FIG. 24. The upper portion of side panel 314 is then folded about fold line 385*b* so that it abuts tab 315 and can be attached thereto for example by gluing, to form the flat structure shown in FIG. 25. Conveniently, blanks 311 can be stored in this flat arrangement and transported to packaging machinery ready to be loaded into suitable hoppers such as hopper H shown schematically in FIG. 30.

Figure 25:
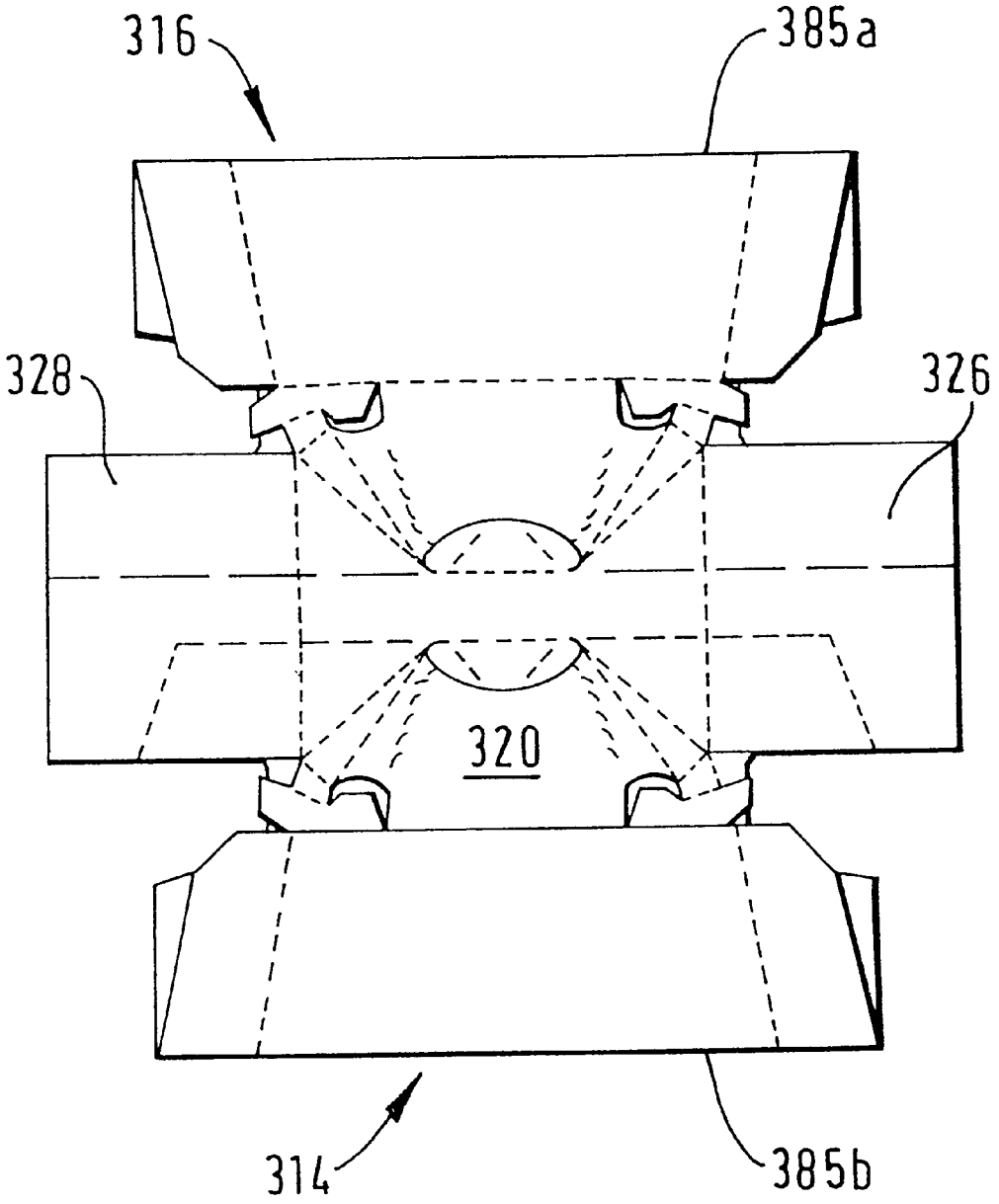
Figure 26:
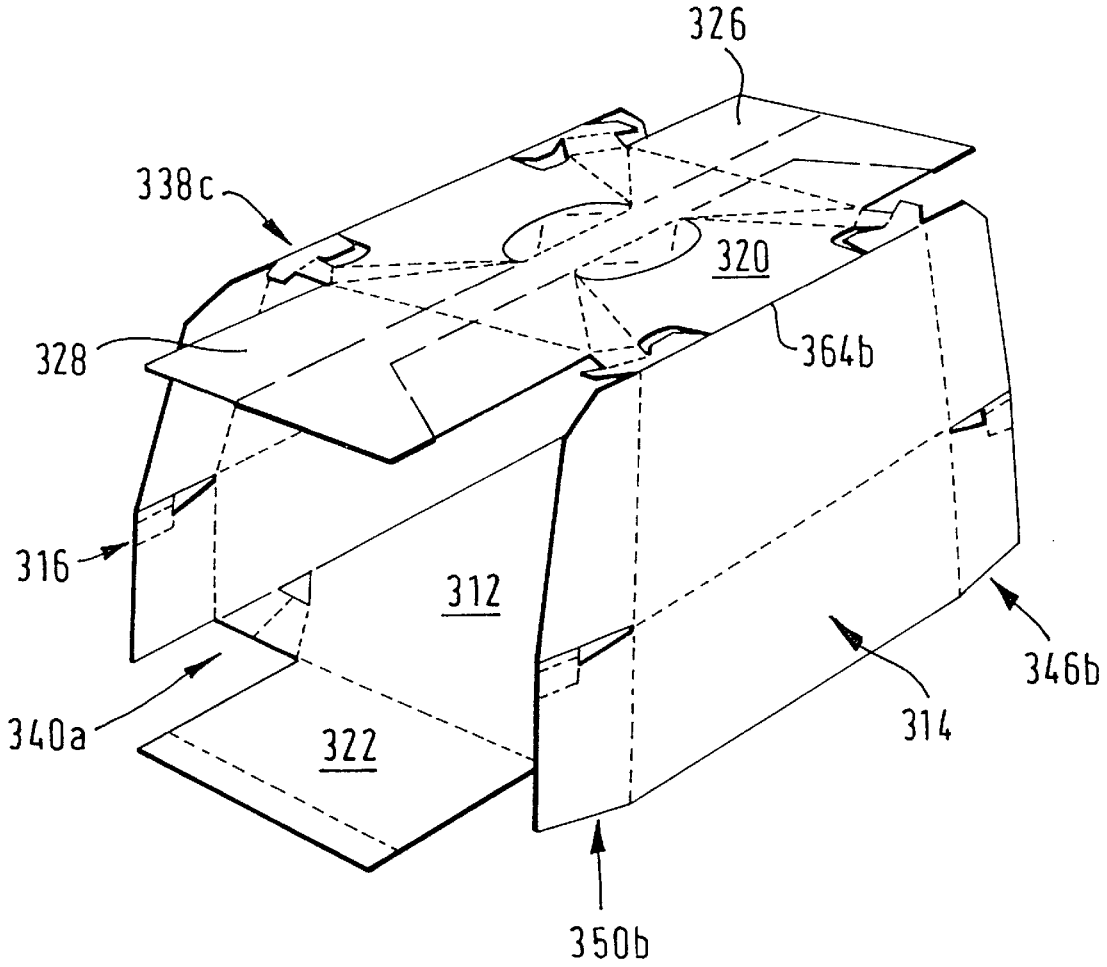
Figure 27:
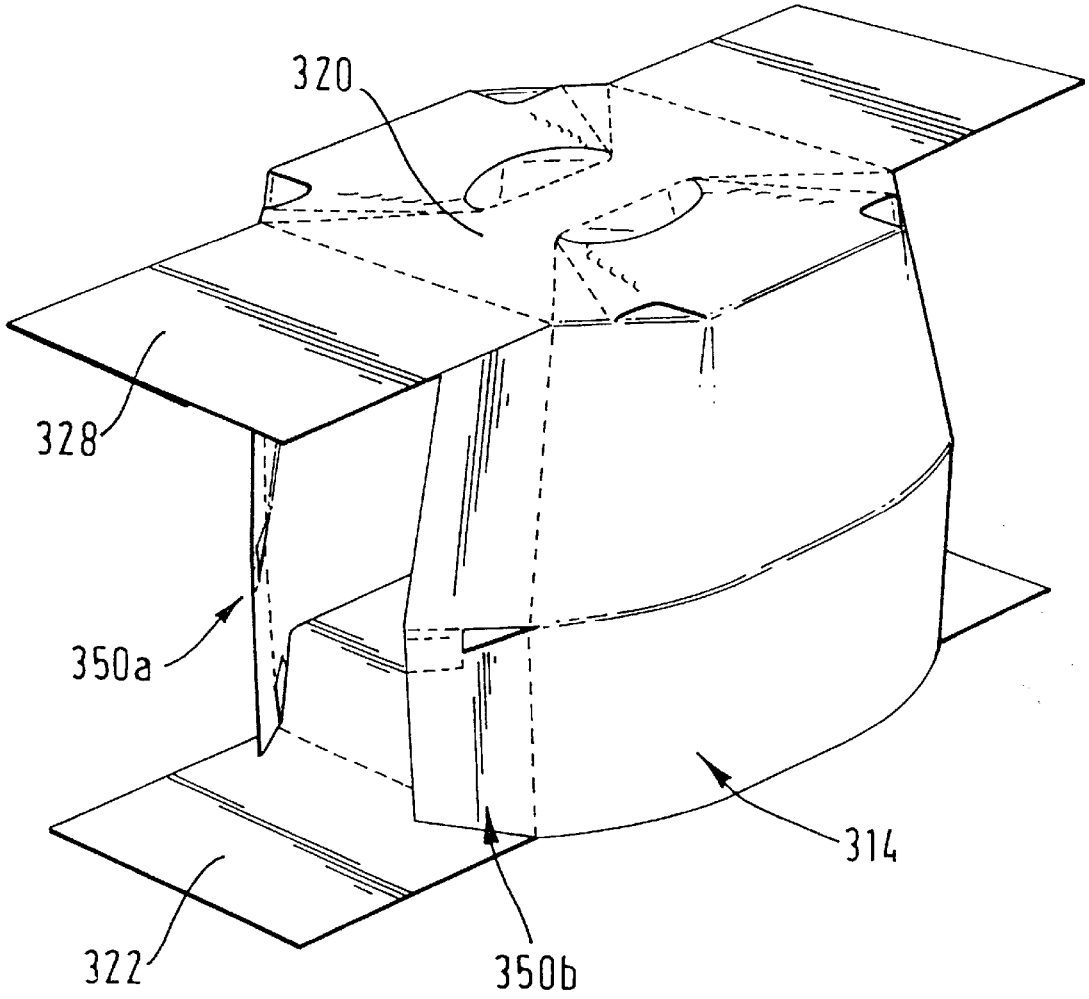

To load a carton the structure shown in FIG. 25 is first expanded into the sleeve like structure as shown in FIG. 26. This is also shown in the upstream part of the packaging process shown in FIG. 30, wherein it is apparent that the carton is moved downstream along the flow direction indicated by arrow F. In this schematic drawing it can be seen that at stage A, the infeed rows of articles are separated into the desired formation of two rows on each of the open ends of the carton comprising an innermost row of four articles and an adjacent outermost row of three articles. The outer row is displaced slightly with respect to the inner row so that the rows of articles are nested thereby to form a relatively tightly packed configuration. That is, an article in the outer row abuts two articles in the inner row. This is not true of the abutment of the two inner rows after they have been loaded into the carton during the phase indicated by section B of FIG. 30. The adjacent innermost rows of four articles abut one another so that only a single article is abutted in the adjacent innermost row. However, for different sizes or shapes of cartons it would of course be possible to provide a different structure of abutment of the articles within the carton.

After loading a carton 320, the gussets 338 and 340 are tucked inwardly in zone C of the flow path shown in FIG. 30. As shown in bubble G of FIG. 30, main gusset panel 358*c* is tucked inwardly to a position beneath top panel 320. Also, as shown in bubble H of FIG. 30, the gussets 340 are tucked upwardly. This tucking action of the gussets causes a bending of the side panels towards the partially closed structure shown in FIG. 27. The endmost parts of the side panels 350*a* and 350*b* can then be drawn further round to the ends of the carton as shown in zone D of FIG. 30. This causes further curvature of side panels 314 and 316 which thereby contour the sides of the adjacent articles and reflect the shape of three sides of the octagonal base panel 312 and top panel 320. Additionally, the upper portions of the side panels 314 and 316 bevel in, or are inclined, thereby to contour the shoulders of the bottles retained within a carton.

Figure 28:
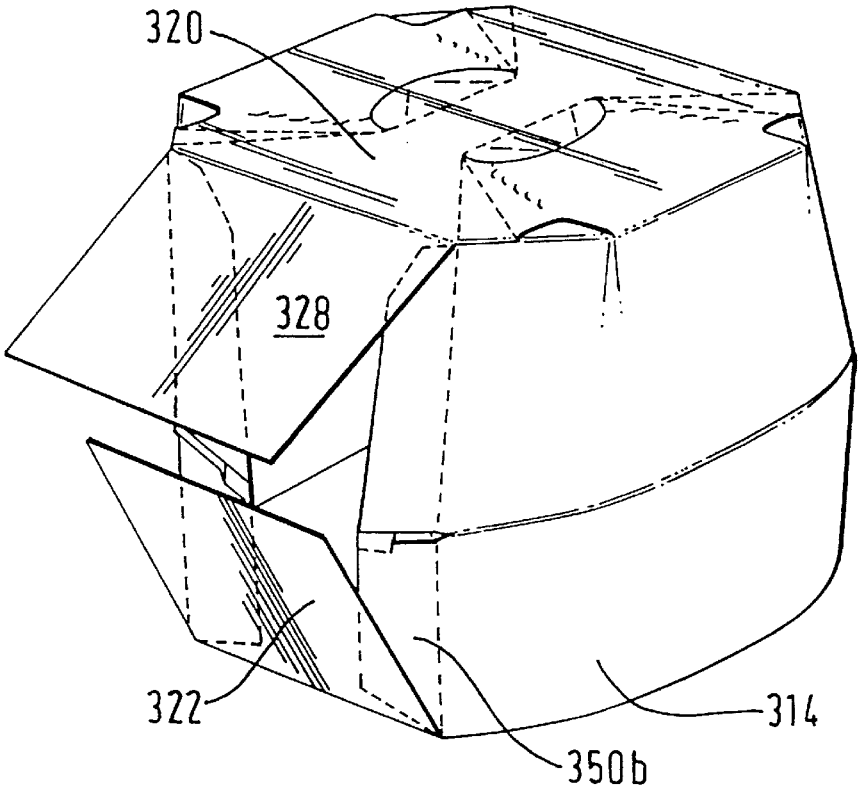

The upper and lower end panels 322, 324, 328 and 326 can then be folded about the associated fold line to the top or lower panel as shown in FIG. 28. The associated upper and lower end panels such as panels 328 and 322 can then be attached to one another for example by gluing. Alternatively, cooperating locking means such as locking tabs and apertures might be provided. Also, the end panels can be attached to the end panels 346*a,* 346*b,* 350*a* and 350*b*. For example, if an adhesive such as glue is used then the finished carton shown in FIG. 29 can be pressed in zone E of FIG. 30 to ensure the panels remain closed.

I claim:

1. A blank for forming a carton for packaging a plurality of articles comprising:

a first panel having a side edge, a first edge and a corner between said side and first edges;

a second panel for disposition along said side and first edges of the first panel to conform with a shape of said first panel upon formation of said carton, said second panel being foldably connected to said first panel along said side edge, said second panel having a second edge in alignment with said side edge, said second edge and a notional extension of said first edge being disposed to converge on said corner; and a gusset extending between said first and second edges and foldably connected to said first and second panels along said first and second edges respectively, said gusset comprising a pair of gusset panels interconnected along a gusset fold line, one of said gusset panels having an aperture adjacent to said corner, said aperture extending into said first panel to facilitate folding of said second panel to allow said second panel to be disposed along said side and first edges of said first panel, said gusset fold line extending from said aperture to a free edge of said one gusset panel, the other gusset panel having a tab protruding into said aperture so that said aperture is closed by said tab upon formation of said carton.

2. The blank according to claim 1, wherein said one gusset panel is foldably connected to said first panel, and said other gusset panel is foldably connected to said second panel.

3. A carton for packaging a plurality of articles comprising:

a non-rectangularly shaped top wall having a side edge, a first edge and a corner between said side and first edge;

a side wall having a second edge and foldably connected to said top wall along said side edge, said first and second edges being disposed generally coincidentally with each other, said side wall being disposed in a folded position where said side wall extends along said side and first edges of said top wall to conform with a shape of said to wall; and a gusset foldably connecting between said first and second edges, said gusset comprising a first gusset panel foldably connected to said top wall and a second gusset panel foldably interconnecting said first gusset panel and said side wall, said gusset being folded and tucked inside said carton such that said first and second gusset panels are in face-contacting relationship with each other and said first gusset panel is in face-contacting relationship with an inside surface of said top wall panel, wherein said first gusset panel has an aperture adjacent to said corner, said aperture extending into said top wall to facilitate folding of said side wall into said folded position, and wherein said second gusset panel has a tab underlying said aperture and disposed such that said aperture is closed by said tab.

4. The carton according to claim 3, wherein said side wall comprises a pair of panel portions foldably interconnected by a fold region, said side wall being folded along said fold region to take said folded position.

5. The carton according to claim 4, wherein said fold region is a curvable portion which provides a rounded corner in said carton.

* * * * *